United States Patent [19]

Toyomaki

[11] 4,300,019

[45] Nov. 10, 1981

[54] METHOD AND APPARATUS FOR MULTIPLYING AN ELECTRICAL SIGNAL

[75] Inventor: Kazuya Toyomaki, Yokohama, Japan

[73] Assignee: Victor Company of Japan, Limited, Yokohama, Japan

[21] Appl. No.: 110,349

[22] Filed: Jan. 7, 1980

[30] Foreign Application Priority Data

Jan. 9, 1979 [JP] Japan ..... 54-1677
Jan. 23, 1979 [JP] Japan ..... 54-6449

[51] Int. Cl.[3] ..... H04H 5/00

[52] U.S. Cl. ..... 179/1 GE; 329/146; 332/41

[58] Field of Search ..... 179/1 GE; 329/146, 167, 329/50; 332/41, 37 R

[56] References Cited

U.S. PATENT DOCUMENTS 3,155,824 11/1964 Rotier ..... 329/146
3,980,832 9/1976 Nakamura et al. ..... 179/1 GE
4,061,882 12/1977 Dorren ..... 179/1 GE

*Primary Examiner*—Douglas W. Olms
*Attorney, Agent, or Firm*—Lowe, King, Price & Becker

[57] ABSTRACT

A multiplier circuitry which multiplies an electrical signal by a multiplier signal comprises an oscillator which oscillates at a frequency having a predetermined relationship with respect to the multiplier signal, a first signal generator for producing an asymmetrical square wave signal in response to the output signal of the oscillator, a frequency divider for dividing the frequency of the asymmetrical square wave signal from the first signal generator by two to produce at least one asymmetrical square wave signal, and a second signal generator for multiplying an input electrical signal by the asymmetrical square wave signal and subsequently by a symmetrical square wave which is obtained from the asymmetrical square wave signal. The methods and apparatus for multiplying an electrical signal according to the present invention may be adapted to a phase comparator, modulator, demodulator and the like.

29 Claims, 19 Drawing Figures

METHOD AND APPARATUS FOR MULTIPLYING AN ELECTRICAL SIGNAL

FIELD OF THE INVENTION

This invention generally relates to methods of multiplying an electrical signal by another electrical signal and apparatus for executing the multiplication of electrical signals. More particularly, the present invention relates to such methods and apparatus which may be adapted to a modulator, demodulator, phase comparator and the like.

BACKGROUND OF THE INVENTION

In a conventional modulator, demodulator, phase comparator or the like, when multiplying an input electrical signal, i.e. a multiplicand signal, by another electrical signal, i.e. a multiplier signal, if the multiplier signal includes high harmonic components therein, the harmonic components will be simultaneously multiplied by unwanted signal components or noise components which might be included in the multiplicand signal so that undesirable spurious signal components will occur in the output product signal obtained by the multiplication.

Although the above described problem should be theoretically resolved by the use of a sinusoidal signal as the multiplier signal, in practice distortion components occur in the output product signal and thus undesirable spurous signal components are produced because it is extremely difficult to obtain a sine wave having negligibly small distortion. Furthermore, the difficulty with the use of a sine wave as a multiplier signal is that the sine wave multiplier signal does not allow switching techniques to be employed for a multiplication has to be done linearly.

On the other hand, in various conventional demodulators or the like, in which a switching technique is utilized, a square wave signal having the same frequency as a multiplier signal, by which an input signal is intended to be multiplied, and a duty cycle of 50 percent, has been used as a multiplier or switching signal.

However, as is well known, since a square wave signal having a duty cycle of 50 percent includes a third harmonic component having a level one third the level of the fundamental frequency although no even harmonics are included therein, if unwanted signals or noise components having a frequency three times the fundamental frequency is included in the input electrical signal, and are multiplied by the multiplier signal in the form of a square wave signal of 50 percent duty cycle, the signal to noise ratio of the resultant product signal will be deteriorated suffering from the beat interference components included in the demodulated signal obtained as the result of the multiplication.

For instance, if a decoding or switching signal used for stereo multiplex decoding includes harmonic distortion components, unwanted signals or noise components, which might be included in a composite stereo signal from an FM detector, will be multiplied by the harmonic distortion components so that interference signals or noises having an audio frequency may occur in the demodulated signals. Assuming that the stereo multiplex decoding signal having a fundamental frequency of 38 KHz includes a third harmonic component (114 KHz), and further the composite stereo signal, which is the objective of the stereo multiplex demodulation, includes an unwanted signal having a frequency in the vicinity of 114 KHz, an audible interference signal will occur in the demodulated signals as the result of the multiplication of the unwanted signal in the vicinity of 114 KHz by the third harmonic component included in the decoding signal.

SUMMARY OF THE INVENTION

The present invention has been developed in order to eliminate the above described disadvantages and drawbacks inherent to the conventional methods and apparatus for multiplying electrical signals.

It is, therefore, a primary object of the present invention to provide methods and apparatus for multiplying electrical signals in which a multiplicand signal is multiplied by a multiplier signal which does not include even harmonic components, a third harmonic component, and multiples of the third harmonic component.

Another object of the present invention is to provide methods and apparatus for multiplying electrical signals in which a multiplicand signal is readily multiplied by a multi-level multiplier signal by a switching technique.

A further object of the present invention is to provide methods and apparatus for multiplying electrical signals in which generation of beat frequency in the product signal is prevented even if a multiplicand signal includes unwanted signal components or noise components having a frequency in the vicinity of the harmonics of a multiplier signal.

A still further object of the present invention is to provide methods and apparatus for multiplying electrical signals in which a product signal having negligibly small distortion is obtained.

According to the present invention, instead of multiplying an input electrical signal by a multi-level symmetrical wave having no even harmonic components, a third harmonic component or multiplies of the third harmonic component, the input electrical signal is multiplied by an asymmetrical square wave signal and then by a symmetrical square wave signal which is obtained from a second asymmetrical square wave signal. The frequency of the first asymmetrical square wave signal is twice the fundamental frequency of the multi-level symmetrical wave, while the frequency of the second asymmetrical square wave and the symmetrical square wave signal equals the fundamental frequency of the multilevel symmetrical wave signal. The phase relationship between these signals is predetermined and the duty cycle of the first asymmetrical square wave signal is made two third, while the duty cycle of the second asymmetrical square wave signal is 50 percent.

The order of the multiplication of the first asymmetrical square wave signal and the multiplication of the symmetrical square wave signal may be reversed. The methods and apparatus for multiplying electrical signals according to the present invention may be adapted to a phase comparator, modulator, demodulator and the like.

BRIEF DESCRIPTION OF THE DRAWINGS

These and other objects and features of the present invention will become more readily apparent from the following detailed description of the preferred embodiments taken in conjunction with the drawings in which.

DETAILED DESCRIPTION OF THE PREFERRED EMBODIMENTS

In order to describe the methods and apparatus according to the present invention, mathematical analysis is given hereinbelow.

Figure 1:
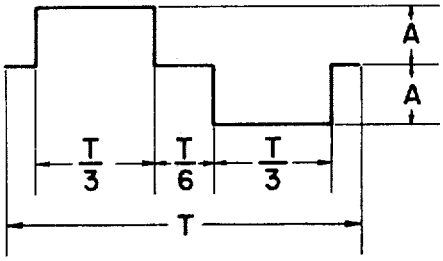
FIG. 1 is a waveform of a multi-level multipler signal used in the present invention.

FIG. 1 illustrates a waveform of the simplest electrical signal which does not include second or third harmonic, and which is easy to produce by a switching circuit. The signal shown in FIG. 1 is mathematically expressed as follows:

$$\frac{2\sqrt{3A}}{\pi}\left(\sin\omega t - \frac{1}{5}\sin 5\,\omega t + \frac{1}{7}\sin 7\,\omega t + \frac{1}{11}\sin 11\,\omega t + \frac{1}{13}\sin 13\,\omega t - \frac{1}{17}\sin 17\,\omega t - \frac{1}{19}\sin 19\,\omega t + \frac{1}{23}\sin 23\,\omega t + \frac{1}{25}\sin 25\,\omega t - \ldots\right) \quad (1)$$

wherein

A is the amplitude of the signal (peak to peak amplitude equals 2A);

T is the period; and $\omega$ is the angle frequency:

(In the above formula (1), terms corresponding to the phase are omitted.)

As will be apparent from the above formula (1), the signal shown in FIG. 1 does not include even harmonics, a third harmonic and harmonics of multiples of the third order.

According to the present invention, a multiplicand signal is multiplied by a multiplier signal, such as shown in FIG. 1, to produce a resultant product signal, in which a plurality of specific square wave components which constitute the multiplier signal are respectively used as actual multipliers.

Figure 2:
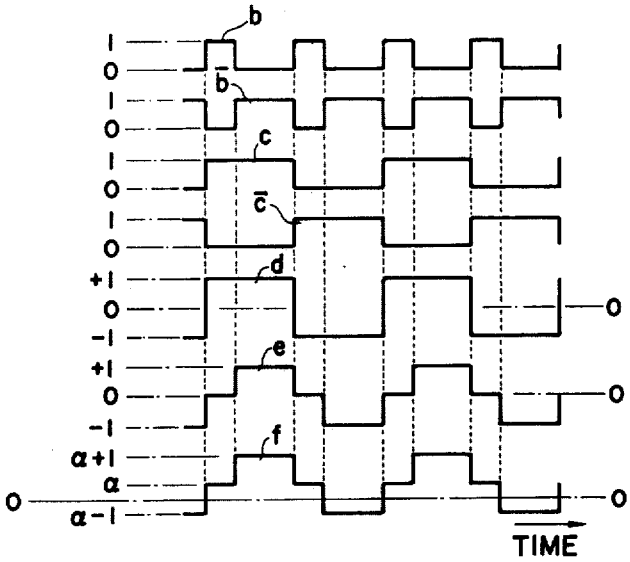
FIG. 2 is a waveform chart showing various signals used in the embodiments of the present invention.

FIG. 2 is a waveform chart showing various signals used in the methods and apparatus according to the present invention. In FIG. 2, a waveform "d" indicates a symmetrical rectangular or square wave signal having a frequency the same as that of a multiplier signal used in conventional multipliers to which switching technique is adapted. A waveform "b" indicates an asymmetrical square wave signal having a frequency twice the fundamental frequency and a duty cycle of two third. Assuming that the signal "d" is multiplied by the signal "$\bar{b}$", the resultant product signal has a waveform designated as "e", and it will be recognized that the waveform of the signal "e" equals that of the signal shown in FIG. 1.

This means that the multiplication of an input electrical signal, which is treated as a multiplicand signal, by the signals "$\bar{b}$" and "d" is equivalent to the multiplication of the input electrical signal by the signal "e".

Therefore, by multiplying the input signal by the signal "$\bar{b}$" and the signal "d" it is possible to actualize a multiplication in which a product signal including no even harmonic components, the third harmonic component and harmonic components of the multiples of the third order is obtained.

Here, it is to be noted that even if the phase of the signal "e" deviates from the illustrated position or time as much as T/6 in the rightward direction in the drawing, we can obtain the result of the multiplication of the signal "d" by the signal "$\bar{b}$" as illustrated by the waveform "e".

Figure 3:
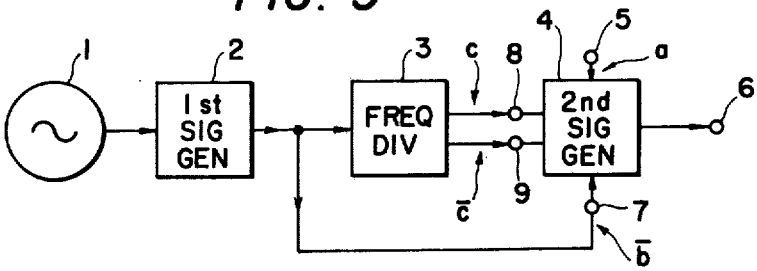
FIG. 3 is a block diagram of an embodiment of the multiplier circuitry according to the present invention.

FIG. 3 is a block diagram of an embodiment of the apparatus for carrying out the method of multiplication according to the present invention. The apparatus comprises an oscillator 1, a first signal generator 2, a frequency divider 3 and a second signal generator 4. The oscillator 1 oscillates at a frequency which is an integral multiple of the fundamental frequency of the multiplier signal by which an input electrical signal (multiplicand) will be multiplied. The phase of the output signal of the oscillator 1 is adjusted in such a manner that the phase has a predetermined relationship with respect to the phase of the fundamental frequency. Hereinbelow the terms "the fundamental frequency" are used to mean the fundamental frequency of the multiplier signal, such as the signal "e", of FIG. 2 having multi levels. The output terminal of the oscillator 1 is connected to an input terminal of the first signal generator 2, the output terminal of which is connected to an input terminal of the frequency divider 3 and to an input terminal of the second signal generator 4. The first signal generator 2 generates an output square wave signal in response to the output signal of the oscillator 1, having a frequency twice the fundamental frequency of the multiplier signal, where the square wave signal has a predetermined duty cycle. For instance, the output signal of the first signal generator 2 may be one of the signals "b" and "$\bar{b}$" shown in FIG. 2. The frequency divider 3 is responsive to the output signal, such as the signal "b" or "$\bar{b}$", of the first signal generator 2 and divides the frequency of its input signal by two, and the frequency divider 3 is arranged to produce a pair of output square wave signals such as signals "c" and "$\bar{c}$". The second signal generator 4 has first, second, third and fourth input terminals 5, 7, 8 and 9, and an output terminal 6. The first input terminal 5 is responsive to the input electrical signal "a", and the second input terminal 7 is responsive to the output signal, such as the signal "$\bar{b}$", of the first signal generator 2. The third and fourth input terminals 8 and 9 are respectively responsive to the output signals, such as signals "c" and "$\bar{c}$", of the frequency divider 3. The signals "c" and "$\bar{c}$" are combined with each other to produce a signal, such as the signal "d", in the second signal generator 4. The input electrical signal "a" is multiplied by the signals "d" and "$\bar{b}$" in the second signal generator 4 as will be described in detail hereinlater. The resultant product signal is derived from the output terminal 6.

As the above mentioned oscillator 1, a voltage or current controlled oscillator, in which the frequency and the phase can be controlled, may be used.

As the above mentioned first signal generator 2, a divide-by-three frequency divider (a ternary counter) may be used. When such a divide-by-three frequency divider is used as the first signal generator 2, the frequency of the output signal of the oscillator 1 is either six times the fundamental frequency or two third times the fundamental frequency. If the frequency of the output signal of the oscillator 1 is six times the fundamental frequency, an output signal such as the signal "b" is obtained at the output terminal of the first signal generator 2, where the signal "b" is an asymmetrical square wave signal having a duty cycle of one third. On the other hand, if the frequency of the output signal of the oscillator 1 is two third times the fundamental frequency, an output signal, such as the signal "$\bar{b}$", is obtained at the output terminal of the first signal generator 2, wherein the signal "b" is an asymmetrical square wave signal having a duty cycle of two third.

The construction of the fist signal generator 2 is not limited to such a frequency divider, and thus a monostable multivibrator may be used therefor. In this case, the frequency of the output signal of the oscillator 1 equals twice the fundamental frequency, and thus pulse width of the output signal of the monostable multivibrator is selected so that the pulse width corresponds to either one third or two third the oscillation period of the oscillator 1. It will be understood that when the oscillator 1 and the first signal generator 2 are arranged in the above mentioned manner, the monostable multivibrator produces an output signal such as the signal "b" and/or "$\bar{b}$".

Furthermore, the first signal generator 2 may be a threshold circuit such as a comparator which is responsive to the output voltage of the oscillator 1 and to a threshold reference voltage. In this case, the oscillator 1 may be a saw tooth wave signal generator. The threshold circuit produces high and low level outputs in accordance with the voltage from the saw tooth wave signal generator so that the threshold circuit functions as a switching circuit.

As the above mentioned frequency divider 3, for instance, a customary flip-flop may be used as a divided-by-two frequency divider. The divided-by-two frequency divider divides the frequency of the input signal by two so that it produces one of the signals "c" and "$\bar{c}$" or both the signals "c" and "$\bar{c}$" at the output terminal(s) thereof. The frequency divider 3 may be responsive to the leading edge or the trailing edge of the pulses from the first signal generator 2. If the signal delay due to the frequency dividing operation is negligibly small, or does not exist, any one of the types above mentioned may be used.

The second signal generator 4 has two functions, i.e. the multiplication of the signal "$\bar{b}$" component and the multiplication of the signal "d" component. As described hereinabove, the input electrical signal "a" is multiplied by the signals "$\bar{b}$" and "d", and the order of the multiplications by these signals "$\bar{b}$" and "d" with respect to the input signal "a" can be reversed. In other words, the input signal "a" may be multiplied by the signal "$\bar{b}$" before the input signal "a" is multiplied by the signal "d" or vice versa. As the second signal generator there are a number of possibilities as will be described hereinbelow.

In order to carry out the multiplication of the signal "$\bar{b}$" a customary multiplier, such as an unbalanced multiplier, in which switching is performed, may be used. On the other hand, in order to effect the multiplication of the signal "d", a balanced multiplier, which is also used in a conventional multiplier, may be used. However, it is also possible to subtract an output signal obtained by an unbalanced multiplier which multiplies the input signal "a" by the signal "c" from an output signal obtained by another unbalanced multiplier which multiplies the input signal "a" by the signal "$\bar{c}$".

The embodiments of the second signal generator 4 will be described hereunder in connection with FIG. 4 to FIG. 11.

Figure 4:
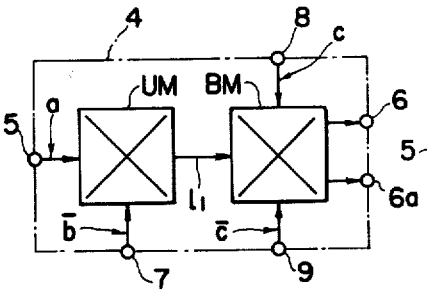
FIG. 4 is a block diagram of a first embodiment of the second signal generator shown in FIG. 3.

FIG. 4 is a block diagram of a first embodiment of the second signal generator 4 shown in FIG. 3. In FIG. 4 and other drawings, UM stands for an unbalanced multiplier, while BM stands for a balanced multiplier. The reference numerals designating the input terminals and the output terminal of the second signal generator 4 are common throughout FIGS. 4 to 9 and correspond to those in FIG. 3. With reference to FIG. 4, an unbalanced multiplier UM is supplied with an input multiplicand signal "a" via the first input terminal 5, and with the signal "$\bar{b}$" via the second input terminal 7. An output terminal of the unbalanced multiplier UM is connected through a conductor $1_1$ to an input terminal of a balanced multiplier BM so that the resultant product signal obtained by the multiplication of the signal "a" by the signal "$\bar{b}$" is applied to the balanced multiplier BM.

The balanced multiplier BM is also supplied with signals "c" and "$\bar{c}$" via the third and fourth input terminals 8 and 9, The combination of these signals "c" and "$\bar{c}$" is used as the multiplier signal "d" so that the product signal from the unbalanced multiplier UM is substantially multiplied by the signal "d" in the balanced multiplier BM. As the result of the multiplication in the balanced multiplier BM, a resultant product signal is obtained at the output terminal 6 of the second signal generator 4, which output terminal 6 is connected to an output terminal of the balanced multiplier BM. The balanced multiplier BM may include another output terminal connected to an additional output terminal 6*a* to deliver an output signal which has an inverted phase with respect to the output signal at the output terminal 6. This phase-inverted signal may be utilized in a following circuit if necessary.

Although in the above described embodiment, a pair of signals "c" and "$\bar{c}$" are fed to the balanced multiplier BM, it is possible to apply only one of the signals "c" and "$\bar{c}$" to the balanced multiplier BM if the balanced multiplier BM is so arranged that the signal "d" is substantially obtained on the basis of the signal "c" or "$\bar{c}$".

Figure 5:
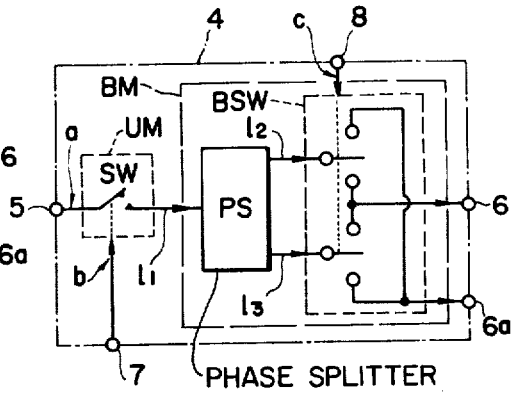
FIG. 5 is a schematic diagram illustrating the function of the second signal generator of FIG. 4.

FIG. 5 illustrates a functional block diagram corresponding to the second signal generator 4 shown in FIG. 4. In FIG. 5, the unbalanced multiplier UM is shown in the form of a switching circuit SW which closes its contacts to pass the signal from the first input terminal 5 in accordance with the signal "b", which signal "b" is used as the switching control signal. Although the function of the unbalanced multiplier UM shown in the form of a switching circuit in FIG. 5, is to multiply the input signal "a" by the signal "$\bar{b}$", the signal which is applied to the second input terminal 7 does not necessarily equal the signal "$\bar{b}$". Namely, the signal to be applied to the second input terminal 7 as the switching signal may be the signal "b" which is an inverted signal of the signal "$\bar{b}$", depending on the construction of the switching circuit SW included in the unbalanced multiplier UM. In the illustrated example of FIG. 5, the multiplication of the input signal "a" by the signal $\bar{b}$ is actually achieved by switching the input signal "a" at intervals defined by the switching control signal "b".

The balanced multiplier BM shown in FIG. 4 may be divided into two portions, namely, a phase splitter PS and a balanced switching circuit BSW as shown in FIG. 5. The product signal obtained by the multiplication of the input signal "a" by the signal "$\bar{b}$" and is applied to the phase splitter PS via the conductor $\mathbf{1}_1$ and is converted into two electrical signals, which usually take the form of current signals, which have opposite phase with each other. These two signals produced by the phase splitter PS are respectively applied via conductors $\mathbf{1}_2$ and $\mathbf{1}_3$ to input terminals of the balanced switching circuit BSW. In other words, the signal along the conductor $\mathbf{1}_2$ is in phase with respect to the phase of the signal at the input terminal of the phase splitter PS, while the signal along the conductor $\mathbf{1}_3$ has a phase different from that of the signal along the conductor $\mathbf{1}_2$ by 180 degrees.

The balanced switching circuit BSW is shown in the form of a gang switch which is controlled by a switching control signal "c" applied to the third input terminal 8. The gang switch is of the double-pole double-throw type and have two movable contacts and four stationary contacts. The movable contacts are respctively connected to the conductors $\mathbf{1}_2$ and $\mathbf{1}_3$, while the first and fourth stationary contacts which are respectively contactable with the first and second movable contacts are connected to the output terminal 6*a*, and the second and third stationary contacts which are respectively contactable with the first and second movable contacts are connected to the second output terminal 6. Although the gang switch is shown to be controlled by the signal "c", the inverted signal "$\bar{c}$" may be used in place of the signal "c" to control the gang switch. Furthermore, the two signals "c" and "$\bar{c}$" from the frequency divider 3 of FIG. 3 may be respectively applied to the third and fourth input terminals 8 and 9 as shown in FIG. 4 to control two independent double-pole switches. In other words, in order to control the switches one of the signals "c" and "$\bar{c}$", or both of the signals "c" and "$\bar{c}$" can be used.

Since the balanced switching circuit BSW alternatively switches over the input signal applied through the conductor $\mathbf{1}_1$ in accordance with one of the signals "c" and "$\bar{c}$", or both of the signals "c" and "$\bar{c}$", which is/are used as (a) switching control signal(s), an output product signal indicative of the product of the input signal "a" and the symmetrical square wave signal, such as the signal "d" shown in FIG. 2, will be derived from the first output terminal 6 of the second signal generator 4.

On the other hand, another product signal which corresponds to an inverted signal with respect to the product signal at the first output terminal 6, will be obtained at the second output terminal 6*a*. This inverted product signal developed at the second output terminal 6*a* is also required in some demodulators.

The signals "c" and "$\bar{c}$" applied to the third and fourth input terminals are not used in the balanced switching circuit BSW as (a) multiplier(s) signal per se. Namely, one of these signals "c" and "$\bar{c}$" or both of the signals "c" and "$\bar{c}$" is/are used as (a) switching control signal(s) to alternatively transmit the signals applied through the conductors $\mathbf{1}_2$ and $\mathbf{1}_3$. As the result, the multiplication by the symmetrical square wave signal "d" is substantially achieved.

In other words, the waveform of one of the signals "c" and "$\bar{c}$" or the waveforms of both of the signals "c" and "$\bar{c}$" is (are) regarded as the waveform of the signal "d" so that the multiplication is effected as if one of the signals "c" and "$\bar{c}$", or both of the signals "c" and "$\bar{c}$" has (have) the waveform component of the signal "d".

In this way, the second signal generator 4 of FIG. 4, which is functionally illustrated in FIG. 5, is capable of producing a resultant product signal expressed in terms of $a \cdot \bar{b} \cdot c$ and delivering the same to the output terminal 6, by executing the multiplication of the signals "a", "$\bar{b}$" and "d".

Figure 6:
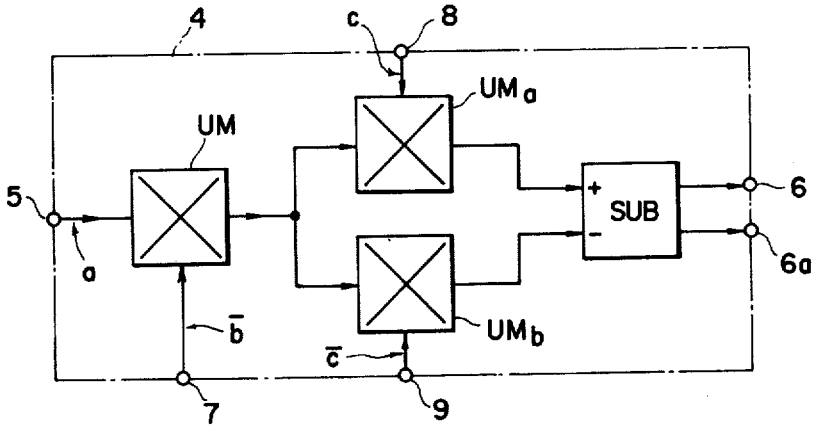
FIG. 6 to FIG. 9 are block diagrams of second to fifth embodiments of the second signal generator shown in FIG. 3.

FIG. 6 is a block diagram of a second embodiment of the second signal generator 4 shown in FIG. 3. The circuitry of FIG. 6 comprises first, second and third unbalanced multipliers UM, UMa and UMb, and a subtracter SUB. The first unbalanced multiplier UM is connected to the first and second input terminals 5 and 7 in the same manner as in FIG. 4. The output terminal of the first unbalanced multiplier UM is connected to input terminals of the second and third unbalanced multipliers UMa and UMb which are also respectively responsive to the signals "c" and "$\bar{c}$" applied to the third and fourth input terminals 8 and 9. The output terminal of the second unbalanced multiplier UMa is connected to a noninverting input (+) of the subtractor SUB, while the output terminal of the third unbalanced multiplier UMb is connected to an inverting input (−) of the subtracter SUB. The subtracter SUB has first and second output terminals which are respctively connected to the first and second output terminals 6 and 6*a* of the second signal generator 4.

The first unbalanced multiplier UM multiplies the input electrical signal "a" applied through the first input terminal 5 by the signal "$\bar{b}$" applied through the second input terminal 7 so that a product signal expressed in terms of $a \cdot \bar{b}$ is obtained and this product signal is applied to the second and third unbalanced multipliers UMa and UMb. The second unbalanced multiplier UMa multiplies the product signal $a \cdot \bar{b}$ by the signal "c" from the third input terminal 8, while the third unbalanced multiplier UMb multiplies the signal $a \cdot \bar{b}$ by the signal "$\bar{c}$" from the fourth input terminal 9. The output signals of the second and third unbalanced multipliers UMa and UMb are respectively representative of the results of the above mentioned multiplications and these output signals are fed to the subtracter SUB as a minuend signal and a subtrahend signal. In the second signal generator 4 shown in FIG. 6, the combination of the second and third unbalanced multipliers UMa and UMb and the subtracter SUB is equivalent to the balanced multiplier BM of FIG. 4 in function.

Namely, the result of the subtraction of a product signal obtained by the multiplication of a given signal by the signal "$\bar{c}$", from another product signal obtained by the multiplication of the given signal by the signal "c", equals the result of multiplication of a subtraction signal representative of the difference between signals "c" and "$\bar{c}$", by the given signal. This is because, in the above both cases, a given signal is multiplied by the signal "d" which has a waveform component expressed in terms of (signal "c"- signal "$\bar{c}$") or a given signal is multiplied by the signal "$\bar{d}$" which has a waveform component expressed in terms of (signal "$\bar{c}$"- signal "C").

Accordingly, a first resultant product signal expressed in terms of $a\cdot\bar{b}\cdot d$ obtained by the multiplication of signals "a", "$\bar{b}$" and "d" is delivered to the first output terminal 6 of the second signal generator 4 of FIG. 6, while a second resultant product signal expressed in terms of $a\cdot\bar{b}\cdot\bar{d}$ obtained by the multiplication of signals "a", "$\bar{b}$" and "$\bar{d}$" is delivered to the second output terminal 6*a*.

The signals applied to the second third and fourth input terminals 7, 8 and 9 are not necessarily in the form of respective multiplier signals in the same manner as described in connection with FIG. 5. Namely, the signals "$\bar{b}$", "c" and "$\bar{c}$" which will be used as multipliers may be applied in the form of inverted signals thereof. Therefore, the signals "$\bar{b}$", "c" and "$\bar{c}$" may be applied actually in the form of signals "b", "$\bar{c}$" and "c" depending on the construction of the switching circuits of each unbalanced multiplier.

Figure 7:
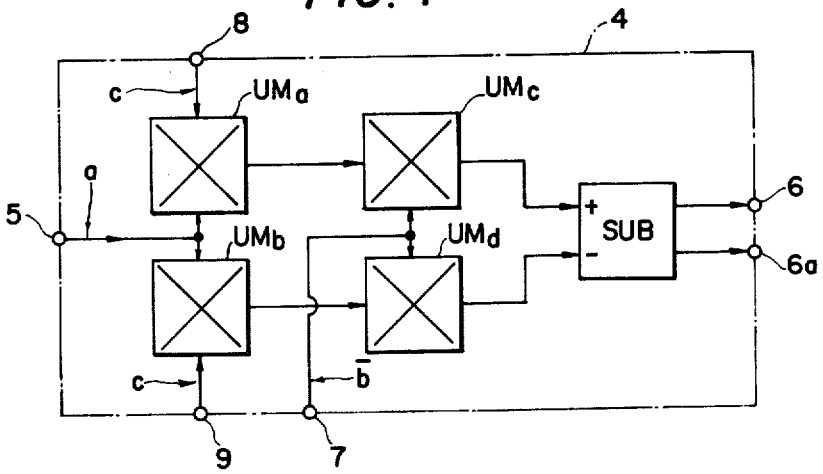

Reference is now made to FIG. 7 which shows a block diagram of the third embodiment of the second signal generator 4 shown in FIG. 3. In the circuitry of FIG. 7, the stage of the multiplication by the signal "$\bar{b}$" and the stage of the multiplication by the signals "c" and "$\bar{c}$" are exchanged with respect to the construction of FIG. 6.

The circuitry of FIG. 7 comprises first to fourth unbalanced multipliers UMa, UMb, UMc and UMd, and a subtractor SUB. The first input terminal 5 is connected to respective input terminals of the first and second unbalanced multipliers UMa and UMb, which are respectively responsive to the signals "c" and "$\bar{c}$" applied via the third and fourth input terminals 8 and 9. The output terminal of the first unbalanced multiplier UMa is connected to an input terminal of the third unbalanced multiplier UMc, while the output terminal of the second unbalanced multiplier UMb is connected to an input terminal of the fourth unbalanced multiplier UMd. Each of the third and fourth unbalanced multipliers UMc and UMd has a second input terminal connected to the second input terminal 7 of the second signal generator 4 for receiving the signal "$\bar{b}$". The output terminal of the third unbalanced multiplier UMc is connected to a noninverting input terminal (+) of the subtracter SUB, while the output terminal of the fourth unbalanced multiplier UMd is connected to an inverting input terminal (−) of the subtracter SUB. The output terminals of the subtracter SUB are connected to the first and second output terminals 6 and 6*a* of the second signal generator 4 in the same manner as in FIG. 6.

The first unbalanced multiplier UMa multiplies the input signal "a" by the signal "c" to produce a product signal expressed in terms of $a\cdot c$, while the second unbalanced multiplier UMb multiplies the input signal "a" by the signal "$\bar{c}$" to produce a product signal expressed in terms of $a\cdot\bar{c}$. The output signal $a\cdot c$ of the first unbalanced multiplier UMa and the output signal $a\cdot\bar{c}$ of the second unbalanced multiplier UMb are respectively applied to the third and fourth unbalanced multipliers UMc and UMd in which these signals are respectively multiplied by the signal "$\bar{b}$". Namely, the third unbalanced multiplier UMc transmits a product signal expressed in terms of $a\cdot\bar{b}\cdot c$ to the noninverting input terminal (+) of the subtracter SUB, as a minuend signal, while the fourth unbalanced multiplier UMd transmits a product signal expressed in terms of $a\cdot\bar{b}\cdot\bar{c}$ to the inverting input terminal (−) of the subtracter SUB as a subtrahend signal. The subtracter SUB subtracts the signal $a\cdot\bar{b}\cdot\bar{c}$ from the signal $a\cdot\bar{b}\cdot c$ to produce an output signal expressed in terms of $a\cdot\bar{b}(c-\bar{c})$, and this signal is delivered to the first output terminal 6. Meanwhile, the subtracter SUB also produces a second output signal expressed in terms of $a\cdot\bar{b}(\bar{c}-c)$, and this signal is transmitted to the second output terminal 6*a*. Since the terms expressed by $(c-\bar{c})$ correspond to the signal "d", and the terms expressed by $(\bar{c}-c)$ correspond to the signal "$\bar{d}$", the output signals at the first and second output terminals 6 and 6*a* can be treated as being expressed in terms of $a\cdot\bar{b}\cdot d$ and $a\cdot\bar{b}\cdot\bar{d}$ respectively.

Figure 8:
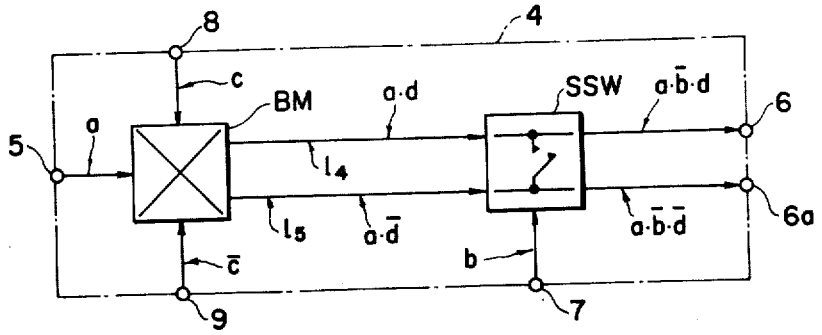

FIG. 8 is a block diagram of the fourth embodiment of the second signal generator 4 shown in FIG. 3, and the circuitry of FIG. 8 comprises a balanced multiplier BM and a switching circuit SSW. The first input terminal 5 is connected to the balanced multiplier BM which is also responsive to the signals "c" and "$\bar{c}$" applied via the third and fourth input terminals 8 and 9. The balanced multiplier BM has two output terminals which are respectively connected via conductors $\mathbf{1}_4$ and $\mathbf{1}_5$ to input terminals of the switching circuit SSW which is responsive to the signals "b" applied via the second input terminal 7. The switching circuit SSW has two output terminals respectively connected to first and second output terminals 6 and 6*a* of the second signal generator 4.

The balanced multiplier BM produces first and second output signals respectively expressed in terms of $a\cdot d$ and $a\cdot d$, and these signals $a\cdot d$ and $a\cdot\bar{d}$ are respectively transmitted via the conductors $\mathbf{1}_4$ and $\mathbf{1}_5$ to the switching circuit SSW. Namely, the signals "c" and "$\bar{c}$" respectively applied to the balanced multiplier BM are used in place of the symmetrical square wave signal "d" in the same manner as described hereinabove in connection with FIG. 5.

The switching circuit SSW is shown in the form of a single switch interposed between two conductors. This means that the switching circuit makes a short circuit when closed. The switching circuit SSW is controlled by the signal "b" applied via the second input terminal 7 so that the conductors $\mathbf{1}_4$ and $\mathbf{1}_5$ connected to the switching circuit SSW are electrically connected at intervals defined by the width of the pulse signal "b". The input signals of the switching circuit SSW via the conductors $\mathbf{1}_4$ and $\mathbf{1}_5$ have opposite phase with each other so that when the switching circuit SSW is in its closed condition, the two input signals negate or cancel each other resulting in the production of no signal component. The output terminals of the switching circuit SSW are directly connected to the input terminals thereof and are connected to the first and second output terminals 6 and 6*a* of the second signal generator 4. On the other hand, when the switching circuit SSW is in its open or OFF condition, the signals from the balanced multiplier BM are respectively transmitted to the first and second output terminals 6 and 6*a* without any change. Accordingly, the switching circuit SSW has a function equivalent to that of the unbalanced multiplier UM of FIG. 4 so that the signal from the conductor $\mathbf{1}_4$ is multiplied by the signal "$\bar{b}$", while the signal from the conductor $1_5$ is also multiplied by the signal "$\bar{b}$". As the result of the multiplications, we will obtain a first product signal expressed in terms of $a \cdot \bar{b} \cdot d$ at the first output terminal 6, and a second product signal expressed in terms of $a \cdot \bar{b} \cdot \bar{d}$ at the second output terminal 6*a*. As described in connection with FIG. 5, one of the signals "b" and "$\bar{b}$" may be used as the switching control signal depending on the construction of the switching circuit SSW.

Figure 9:
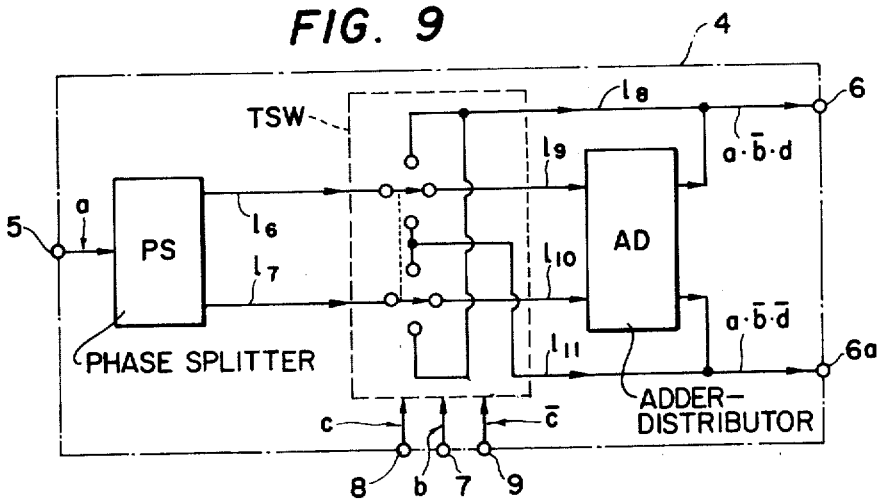

FIG. 9 is a block diagram of the fifth embodiment of the second signal generator 4 shown in FIG. 3. The circuitry of FIG. 9 comprises a phase splitter PS, a gang switch TSW and an adder-distributor AD. The phase splitter PS is responsive to the input signal "a" applied via the first input terminal 5, and produces first and second output signals which have opposite phase with each other. Accordingly, an in-phase signal is delivered through a conductor $1_6$ to the gang switch TSW, while an opposite phase signal is delivered via a conductor $1_7$ to the gang switch TSW. The gang switch actually includes a plurality of semiconductor switches, but for the simplicity the gang switch is illustrated in the form of a triple-pole double-throw gang switch having movable contacts. Each of the movable contact is arranged to be in contact with one of the three stationary contacts of each switch in accordance with the voltage at the second, third and fourth input terminals 7, 8 and 9. In order to control the connections in the gang switch TSW the high level voltage of the signal "b" has to be higher than the high level voltage of the signals "c" and "$\bar{c}$". For instance, if the high level voltages of the signals "c" and "$\bar{c}$" are one volt, the high level voltage of the signal "b" is two volts. Each of the movable contact is arranged to be in contact with the first stationary contact when the voltage of the signal "c" is the highest among the three signals "b", "c" and "$\bar{c}$"; with the second stationary contact when the voltage of the signal "b" is the highest among the same; and with the third stationary contact when the voltage of the signal "$\bar{c}$" is the highest among the same. The first to third stationary contacts of each switch are illustrated from the top to the bottom in the drawing. The first stationary contact of the first switch, the movable contact of which is connected to the conductor $1_6$, and the third stationary contact of the second switch, the movable contact of which is connected to the conductor $1_7$, are connected to each other and are further connected to the first output terminal 6. The third stationary contact of the first switch and the first stationary contact of the second switch are connected to each other and are further connected to the second output terminal 6*a*. The second stationary contacts of the first and second switches are respectively connected via conductors $1_9$ and $1_{10}$ to input terminals of the adder-distributor AD. The adder-distributor AD has two output terminals respectively connected to the first and second output terminals 6 and 6*a*, and may be constructed of two transistors. Since detailed circuit diagrams of the gang switch which actually comprises a plurality of switching transistors, and the adder-distributor are well known, and are disclosed in a U.S. Pat. No. 3,798,376, further description of the construction of these circuits will not be made.

With this provision, the signals from the conductors $1_6$ and $1_7$ are selectively distributed to two of the conductors $1_8$ to $1_{10}$. The adder-distributor AD first adds the input signals from the conductors $1_9$ and $1_{10}$ to each other, and then divides the voltage or current of the added signal into two equal voltages or currents.

Under the condition that the movable contacts of the first and second switches are in contact with respective second stationary contacts, the adder-distributor AD is supplied with the two signals having opposite phase with each other from the phase splitter PS, so that these two signals negate or cancel each other in the same manner as described in connection with FIG. 8 resulting in the production of only a d.c. bias current or voltage at the output terminals thereof.

In this way, the circuitry of FIG. 9 operates in the similar manner to the case of the circuitry of FIG. 8, and thus the circuitry of FIG. 9 produces at its first output terminal 6 a first product signal expressed in terms of $a \cdot \bar{b} \cdot d$, and at its second output terminal 6*a* a second product signal expressed in terms of $a \cdot \bar{b} \cdot \bar{d}$.

Consequently, the second signal generator shown in FIG. 9 has a function of multiplying an input signal "a" by a multiplier signal such as the signal "e" shown in FIG. 2, and by its inverted signal "$\bar{e}$" simultaneously. Namely, the circuitry of FIG. 9 may be regarded as a three-level multiplier.

Figure 10:
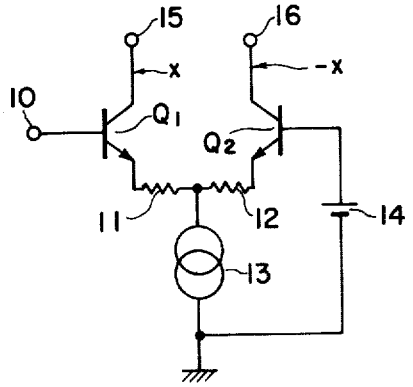
FIG. 10 is a circuit diagram of a phase splitter which may be used for the embodimens of FIGS. 4, 8 and 9.

The phase splitter PS described hereinabove, and shown in the drawings in block diagram form is further shown in the form of a circuit diagram in FIG. 10. The phase splitter PS comprises first and second transistors $Q_1$ and $Q_2$, first and second resistors 11 and 12, a constant-current source 13, and a bias source 14. The phase splitter PS has an input terminal 10 connected to a base electrode of the first transistor $Q_1$, the collector of which is connected to a first output terminal 15. A series circuit of the first and second resistors 11 and 12, the resistances of which are equal to each other, is interposed between the emitter electrodes of the first and second transistors $Q_1$ and $Q_2$. A junction connecting the first and second resistors 11 and 12 are connected via the constant-current source 13 to ground. The bias voltage source 14, which provides a reference bias voltage, is interposed between ground and a base electrode of the second transistor $Q_2$, the collector of which is connected to a second output terminal 16 of the phase splitter PS. As is well known, when an input signal is applied to the input terminal 10, an output signal expressed in terms of X is developed at the first output terminal 15, while a second output signal expressed in terms of $-X$ is developed at the second output terminal 16. This means that the two output signals respectively obtained at the first and second output terminals 15 and 16 have opposite phase with each other.

In various demodulators, a specific signal is sometimes produced by adding or subtracting a demodulating signal, which is obtained as the result of the multiplication, to or from a signal component contained in an input electrical signal which is used as a multiplicand signal. For instance, a demodulator (multiplex decorder) used in an FM (frequency modulated signal) broadcast receiver is given as an example. In an FM stereo multiplex decoder or demodulator, left and right channel audio signals are obtained in the following manner. The left channel signal 2L is obtained by adding a sub signal which corresponds to the result of the multiplication and which has a signal component expressed in terms of $(L-R)$, to a main signal which is included in the input signal and which has a signal component expressed in terms of $(L+R)$, while the right channel signal 2R is obtained by either subtracting the sub signal $(L-R)$ from the main signal $(L+R)$ or adding an inverted sub signal $(R-L)$ to the main signal $(L+R)$.

Figure 11:
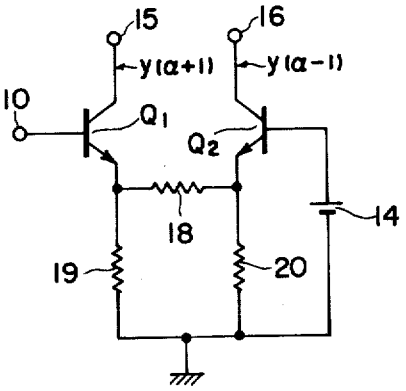
FIG. 11 is a circuit diagram of another phase splitter which may be used for the embodiments of FIGS. 8 and 9.

FIG. 11 illustrates a circuit diagram of a phase splitter PS which is equipped with a function of matrix for the operation of the addition and subtraction mentioned in the above. The phase splitter PS of FIG. 11 has a similar construction to that of FIG. 10 except that the first and second resistors 11 and 12 and the constant-current source 13 are substituted with three resistors 18, 19 and 20. Namely, the emitter electrodes of the first and second transistors $Q_1$ and $Q_2$ are connected via the resistor 18 to each other, while the resistors 19 and 20 are respectively interposed between the bases of the first and second transistors $Q_1$ and $Q_2$ and ground.

Assuming that a first output signal expressed in terms of $\{y(\alpha+1)\}$ is obtained at the first output terminal 15 in response to an input signal applied to the input terminal 10, a second output signal expressed in terms of $\{y(\alpha-1)\}$ is developed at the second output terminal 16. In the above mathematical expressions, "$\alpha$" is a positive constant which is smaller than 1, namely $0<\alpha<1$, and this constant is defined by the resistances of the resistors 18 to 20, and "y" is a voltage-current conversion factor and this factor corresponds to the gain of the circuit. Let us suppose that the voltage-current conversion factor "y" is one, and the phase splitter PS of FIG. 11 is used as the phase splitter PS of FIG. 5. This means that the phase splitter PS of FIG. 11 is combined with the balanced switching circuit BSW to constitute a multiplier. The multiplier supposed in the above, produces an output signal indicative of the product of the multiplication of an input signal by a signal expressed in terms of $(\alpha+d)$, and a second output signal indicative of the product of the multiplication of an input signal by a signal expressed in terms of $(\alpha+\bar{d})=(\alpha-d)$.

This means that two output signals are respectively obtained, wherein the first output signal equals the sum of the product of the input signal and the signal "d", and the input signal multiplied by "$\alpha$"; and the second output signal equals the sum of the product of the input signal and the signal "$\bar{d}$", and the input signal multiplied by "$\alpha$". Consequently, the phase splitter PS of FIG. 11 also serves as a matrix-adder.

If the second signal generator 4, such as shown in FIG. 8 and FIG. 9, comprises the phase splitter PS of FIG. 11, a first output product signal indicative of the result of the multiplication of the input signal by a signal expressed in terms of $(\alpha+e)$ and a second output product signal indicative of the result of the multiplication of the input signal by a signal expressed in terms of $(\alpha-e)$ will be respectively obtained at the output sides thereof. The signal $(\alpha+e)$ is shown in FIG. 2 and is designated as a signal "f". In other words, we are able to obtain output signals which respectively correspond to the sum of the input signal multiplied by the signal "e" and the input signal multiplied by "$\alpha$", and the sum of the input signal multiplied by the inverted signal "$\bar{e}$" and the input signal multiplied by "$\alpha$". The signal "f" shown in FIG. 2 expressed in terms of $(\alpha+e)$, and the signal expressed in terms of $(\alpha-e)$ do not include even harmonic components, a third harmonic component, and the multiplies of the third harmonic component, and thus an output product signal untouched by influence of high harmonic components, is obtained at the output side thereof.

The above mentioned constant "$\alpha$" has to be determined in view of the construction of a demodulator to which the multiplier is adapted.

The addition and subtraction of a signal component included in the multiplicand input signal to and from the product signal which is the result of the multiplication executed by the phase splitter which also serves as a matrix-adder as described hereinabove, are performed only when the second signal generator 4 is of the type that a d.c. component is not lost during the operation thereof. Namely, in the above described embodiments of the second signal generator 4 in connection with FIG. 4 to FIG. 9, the adaption of the phase splitter PS of FIG. 11 is limited to the embodiments of FIG. 8 and FIG. 9.

If the phase splitter PS of FIG. 11, which phase splitter PS also serves as a matrix-adder, is used for the second signal generators 4 which lacks the fidelity with respect to a d.c. component, for instance if the phase splitter PS is used for the embodiment of FIG. 4, the same result as that obtained as described in the above would not be expected. This point will be further described in detail hereinafter.

In case that the phase splitter PS is adapted to one of the embodiments of FIG. 8 and FIG. 9, the circuitry is capable of producing an output signal "y$\alpha$", which is an in-phase component, by combining the output signals $\{y(\alpha+1)\}$ and $\{y(\alpha-1)\}$ of the phase splitter PS during an interval for which the signal "$\bar{b}$" assumes its "0" level, or the signal "b" assumes its "1" level. Ignoring "y" and assuming that the value of "y" is one, the circuitry is capable of producing an output signal indicative of the input signal multiplied by "$\alpha$". However, when the phase splitter PS having a function of a matrix-adder such as shown in FIG. 11, is adapted to the embodiments of FIG. 4, since an output multiplier signal, whose level is shifted by "$\alpha$" from the zero level line as illustrated in FIG. 2, is not obtained, a multiplier which also serves as a matrix-adder cannot be actualized in connection with the embodiment of FIG. 4.

In the above, methods and apparatus for multiplying an input electrical signal by another electrical signal according to the present invention have been described. Now, we are going to describe methods of demodulation of a composite stereo signal derived from an FM detector and apparatus for the same in which the methods and apparatus for multiplying an input signal by another signal according to the present invention are adapted.

Figure 12:
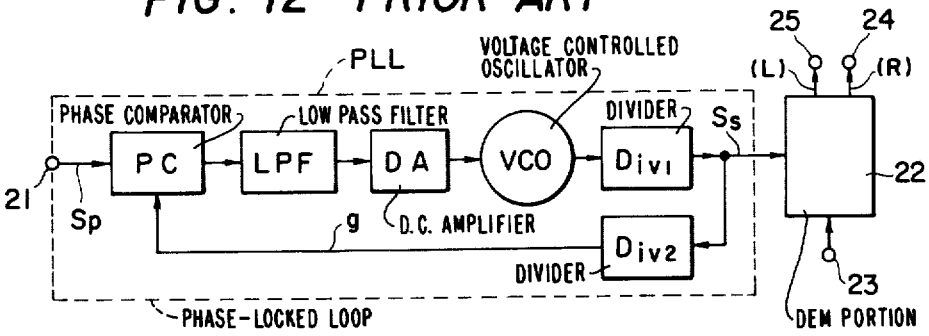
FIG. 12 PRIOR ART
FIG. 12 is a block diagram of a conventional stereo multiplex demodulator.

Reference is now made to FIG. 12 which shows a schematic block diagram of a conventional FM stereo multiplex decoder, in which a phase locked loop (PLL) is used for generating a decoding or switching signal which is used in a following demodulator portion 22 as a multiplier signal. The PLL portion in the multiplex decoder of FIG. 12 is enclosed with a dotted line, and comprises a phase comparator PC, a low pass filter LPF, a d.c. amplifier DA, a voltage controlled oscillator VCO, first and second frequency dividers Div-1 and Div-2. The oscillator VCO may be a current controlled oscillator (CCO) which changes its output frequency in accordance with an input electrical current, and the oscillator VCO oscillates at 76 KHz which equals four times the frequency of a pilot signal $S_p$ applied to an input terminal 21 of the PLL as a reference signal. Actually, a composite stereo signal including a main signal indicative of the stereo signal including a main signal indicative of the sum (L+R) of the left and right channel signals (L) and (R), a sub signal indicative of the difference (L−R) between the left and right channel signals (L) and (R), and a pilot signal of 19 KHz is applied to the input terminal 21. The output signal of 76 KHz developed at the output terminal of the oscillator VCO is applied to the first frequency divider Div-1 and the 76 KHz is divided by two to produce a 38 KHz decoding or switching signal which will be used in the following stage as a stereo demodulation signal. The 38 KHz signal at the output terminal of the first frequency divider Div-1 is supplied to an input terminal of the second frequency divider Div-2 and is divided by two to produce a 19 KHz signal. This 19 KHz signal is fed to the phase comparator PC to be compared with the input pilot signal $S_p$.

The phase comparator PC compares the frequency of the pilot signal $S_p$ with the frequency of the signal from the second frequency divider Div-2 to transmit an error or difference signal to the low pass filter LPF. The error signal passed through the low pass filter LPF is amplified by the d.c. amplifier DA and after the amplification, the error signal is applied to an input terminal of the oscillator VCO as a control signal. The PLL of FIG. 12 is so constructed and arranged that the first frequency divider Div-1 produces an output square wave signal of 38 KHz; the second frequency divider Div-2 produces an output square wave signal of 19 KHz by dividing the 38 KHz signal by two; and thus the 19 KHz square wave signal applied to the phase comparator PC should have the same frequency as that of the pilot signal $S_p$ applied via the input terminal 21, and has a phase difference of 90 degrees with respect to the phase of the reference signal, i.e. the pilot signal $S_p$.

When the PLL is in its locked condition with respect to the reference signal applied to the input terminal 21, the output square wave signal derived from the output terminal of the first frequency divider Div-1 has a frequency of 38 KHz which is twice the frequency of the pilot signal $S_p$, while the output square wave signal has a predetermined relationship with respect to the phase of the composite stereo signal.

Figure 13:
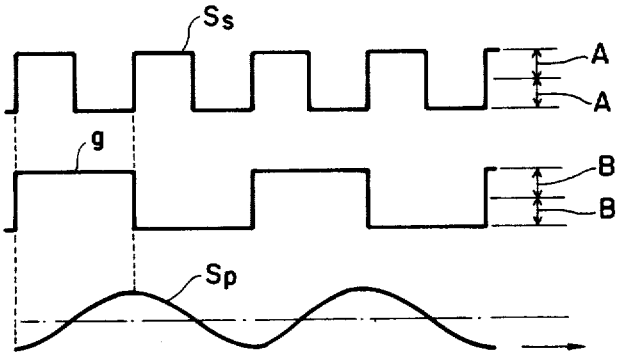
FIG. 13 is a waveform chart useful for the description of the stereo multiplex decoder.

The above mentioned square wave signal from the frequency divider Div-1 is applied to the following demodulator portion 22 as a decoding or switching signal, and has a frequency of 38 KHz, and a duty cycle of 50 percent. The waveform of the switching signal is shown in FIG. 13 and is designated as $S_s$. This switching signal is expressed mathematically as follows:

$$(4A/\pi)(\sin \omega_{38}t + \tfrac{1}{3} \sin 3\omega_{38}t + (1/5) \sin 5\omega_{38}t + \ldots) \quad (2)$$

wherein

A is the amplitude of the switching signal $S_s$ (peak to peak amplitude equals 2A); and $\omega_{38}$ is the angular frequency of the switching signal $S_s$;

As will be apparent from the above formula (2), the switching signal $S_s$ applied to the demodulator portion 22 of FIG. 12 includes odd harmonics of the fundamental frequency; for instance, the third harmonic has its level equal to one third the level of the fundamental frequency component.

Therefore, if the stereo composite signal which is applied to the demodulator portion 22 to which the switching signal $S_s$ from the PLL is also applied, includes unwanted signals or noises having frequency components three times the fundamental frequency of the multiplier signal, i.e. the switching signal, namely frequency components in the vicinity of 114 KHz, spurious signals are apt to be produced by the multiplication of the stereo composite signal by the switching signal $S_s$, which multiplication is performed in the demodulator portion 22. The production of such spurious signals may result in the deterioration in the signal to noise ratio of the stereo demodulated audio signal.

Generally speaking, it is difficult to narrow the range of the intermediate frequency of an FM broadcast receiver within ±100 KHz from the center of the range in view of the demodulation distortion or the like. As the result, unwanted FM broadcast signal of the adjacent channel has a chance to be applied to an FM detector through the intermediate frequency amplifying stage. As the result, an unwanted signal is produced in a frequency range centered at a high frequency range of the detected FM signal, which high frequency range corresponds to the frequency space from the above mentioned adjacent channel, for instance, if the adjacent channel is spaced by 100 KHz, the center frequency is 100 KHz of the detected FM signal. On the other hand, the amplitude of the third harmonic component is the greatest among the odd harmonics of the stereo decoding or switching signal $S_s$, while the frequency of the third harmonic is 114 KHz. For this reason spurious signals are apt to be produced during stereo demodulation in conventional stereo multiplex decoder, and a countermeasure of reduction of such spurious signals has been wanted hitherto.

The demodulator portion 22 of FIG. 12 has an input terminal 23, and first and second output terminals 24 and 25. As is well known, a composite stereo signal is applied to the input termnal 23 of the demodulator portion 22, where the composite stereo signal includes at least a main signal indicative of the sum (L+R) of the left and right channel signals (L) and (R), and a sub signal consisting of an amplitude modulated carrier suppressed signal obtained by amplitude modulating a sub carrier wave by a signal indicative of the difference (L−R) between the left and right channel signals (L) and (R). The demodulator portion 22 performs a multiplication between the composite stereo signal and the above mentioned switching signal $S_s$ derived from the PLL to produce a difference signal (L−R) and an inverted difference signal (R−L) first, and then obtain left and right channel signals (L) and (R) respectively, by matrix combining the difference signal (L−R), the inverted difference signal (R−L) and the composite stereo signal.

The phase comparator PC multiplies the 19 KHz pilot signal $S_p$ by the 19 KHz signal from the second frequency divider Div-2 to produce the error signal through the detection of the phase difference therebetween. The waveform of the signal from the second frequency divider Div-2 is designated as "g". As is shown in FIG. 13, the signal from the second frequency divider Div-2 is a square wave signal, while the pilot signal $S_p$ is a sinusoidal signal. The signal "g" of FIG. 13 may be expressed by the following Fourier series:

$$(4B/\pi)(\sin \omega_{19}t + \tfrac{1}{3} \sin 3\omega_{19}t + (1/5) \sin 5\omega_{19}t + (1/7) \sin 7\omega_{19}t + (1/9) \sin 9\omega_{19}t + \ldots) \quad (3)$$

wherein

B is the amplitude of the square wave "g" (peak to peak amplitude equals 2B); and $\omega_{19}$ is the fundamental angular frequency of the square wave signal "g", which frequency equals that of the pilot signal $S_p$ under the condition that the PLL is locked:

As will be apparent from the above Fourier series (3); the signal "g" applied to the phase comparator PC of the PLL as a comparison signal, includes a fifth harmonic component (95 KHz) having a level equal to one fifth the level of the fundamental wave, and a seventh harmonic component (133 KHz) having a level equal to one seventh the level of the fundamental wave.

These harmonic components will cause the phase comparator PC to produce spurious signal components when unwanted signal components having a frequency, for instance, in the vicinity of 100 KHz is included in the pilot signal $S_P$ applied to the input terminal 21 of the PLL. Most of the spurious signal components produced in the phase comparator PC are eliminated by the low pass filter LPF which follows the phase comparator PC. However, in case that unwanted signal components having a frequency in the vicinity of 95 KHz or 133 KHz is included in the pilot signal $S_p$ applied to the input terminal 21, the frequency of the spurious signal components produced in the phase comparator PC is as low as a d.c. component so that the spurious signal components readily pass through the low pass filter to be transmitted to the oscillator VCO as a control signal. As the result, the oscillator VCO produces an oscillation signal which is phase modulated by the above mentioned unwanted signal components causing the switching signal $S_s$ to be phase modulated. The switching signal $S_s$, which is phase modulated by the unwanted signal components, further causes the demodulated stereo signal to produce spurious signal components therein so that the spurious signal components have been the obstacle to high fidelity stereophonic sound reproduction.

The present invention eliminates the above mentioned disadvantages and drawbacks inherent to the conventional FM stereo muliplex decoders or demodulators by the adaption of the method and apparatus for multiplying an electrical signal described hereinabove with reference to FIG. 4 to FIG. 11. An example of an FM stereo multiplex decoder in which the method and apparatus according to the present invention is employed, will be described hereinbelow.

Figure 14:
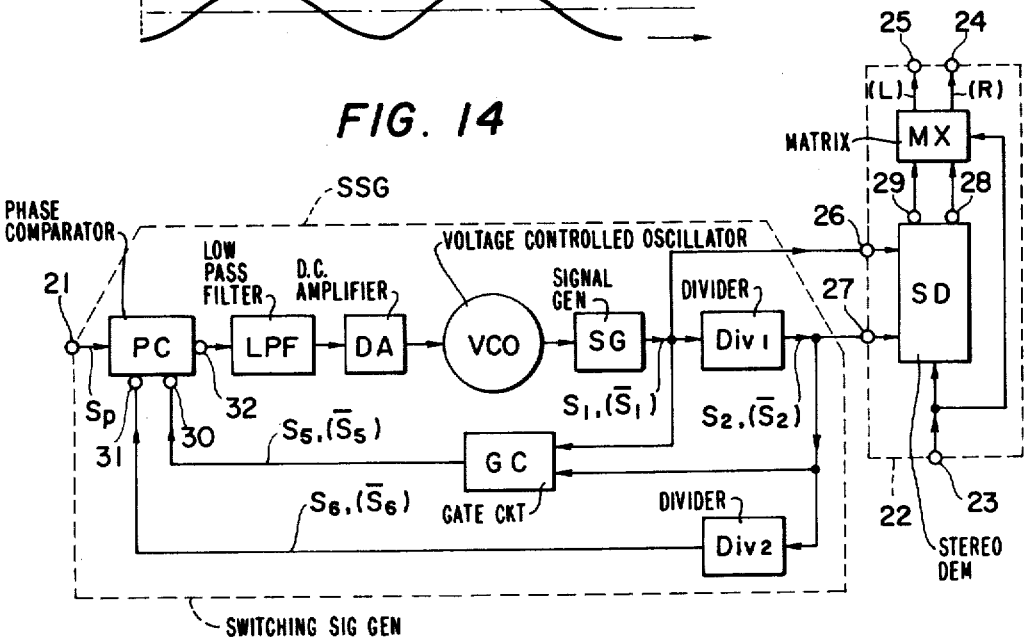
FIG. 14 is a block diagram of a stereo multiplex decoder in which the method and apparatus for multiplying electrical signals according to the present invention are adapted.

FIG. 14 is a block diagram of an embodiment of the stereo multiplex decoder according to the present invention. The circuitry of FIG. 14 comprises a switching signal generator SSG and a stereo demodulating circuit 22 which is referred to as a stereo demodulator portion. The switching signal generator SSG comprises a phase comparator PC, a low pass filter LPF, a d.c. amplifier DA, a voltage controlled oscillator VCO, a signal generating circuit SG, a gate circuit GC, first and second frequency dividers Div-1 and Div-2. The phase comparator PC has first, second and third input terminals, and the first input terminal is connected to the input terminal 21 of the switching signal generator SSG to receive the pilot signal $S_p$ or the composite stereo signal which includes the pilot signal $S_p$. An output terminal of the phase comparator PC is connected via the low pass filter LPF to an input terminal of the d.c. amplifier DA, the output terminal of which is connected to an input terminal of the voltage controlled oscillator VCO. This voltage controlled oscillator VCO may be substituted with a current controlled oscillator as described in conjunction with FIG. 12. An output terminal of the voltage controlled oscillator VCO is connected to an input terminal of the signal generator SG, the output terminal of which is connected to an input terminal of the first frequency divider Div-1 and to an input terminal of the gate circuit GC. The output terminal of the signal generator SG is further connected to an input terminal 26 of the stereo demodulator 22. An output terminal of the first frequency divider Div-1 is connected to a second input terminal of the gate circuit GC and to an input terminal of the second frequency divider Div-2. The output terminal of the first frequency divider Div-1 is further connected to an input terminal 27 of the stereo demodulator 22. An output terminal of the gate circuit GC is connected to the second input terminal 30 of the phase comparator, PC, while an output terminal of the second frequency divider Div-2 is connected to the third input terminal 31 of the phase comparator PC. The switching signal generator SSG is responsive to the pilot signal $S_p$ and is so arranged to produce two square wave signals which will be used in the stereo demodulator portion 22 as switching signals or decording signals.

The stereo demodulator portion 22 comprises a stereo demodulator SD and a matrix MX. The stereo demodulator portion 22 has a first input terminal 23 for receiving the composite stereo signal and the above mentioned second and third input terminals 26 and 27. The stereo demodulator portion 22 further comprises first and second output terminals 24 and 25 to deliver left and right channel audio signals (L) and (R) therethrough. The first to third input terminals 23, 26 and 27 are directly connected to respective input terminals of the stereo demodulator SD, and the first input terminal 23 is additonally connected to the matrix MX, which is responsive to two output signals of the stereo demodulator SD applied through output terminals 28 and 29 of the stereo demodulator SD. The function of the stereo demodulator portion 22 is to multiply the composite stereo signal applied through the first input terminal 23 by the specific square wave switching signals applied from the switching signal generator SSG via the second and third input terminals 26 and 27 to produce a sub signal indicative of the difference (L−R) and its inverted signal (R−L) by the stereo demodulator SD, and then matrixing these signals (L−R) and (R−L) to produce the left and right channel signals (L) and (R) by the matrix MX.

The circuitry of FIG. 14 operates as follows: The oscillation frequency of the oscillator VCO is controllable depending on the voltage or the current of the input signal thereof, and corresponds to the integral multiple of the frequency of a switching or decoding signal which is required to demodulate the composite stereo signal by the stereo demodulator SD. The frequency of the switching signal equals the frequency of a suppressed sub carrier wave, namely it is 38 KHz. The phase of the oscillation signal is so arranged that it has a predetermined relationship with that of the pilot signal $S_p$ applied to the input terminal 21 of the switching signal generator SSG.

Figure 15:
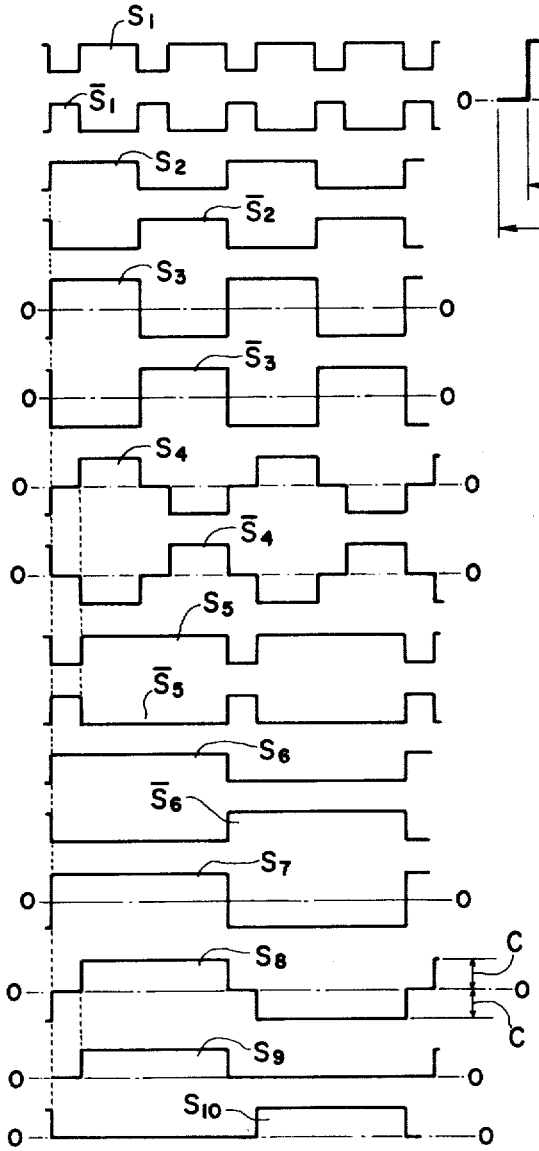
FIG. 15 is a waveform chart of various signals used in the stereo multiplex decoder of FIG. 14.

The signal generator SG is responsive to the output signal of the oscillator VCO to produce an output asymmetrical square wave signal $S_1$ or $\bar{S}_1$ having a frequency (76 KHz) which is twice the frequency (38 KHz) of the sub carrier wave, and a predetermined duty cycle, such as two third or one third, as shown in FIG. 15. The signal $S_1$ or $\bar{S}_1$ is applied to the gate circuit GC, to the first frequency divider Div-1, and to the second input terminal 26 of the stereo demodulator portion 22.

The first frequency divider Div-1 is responsive to the signal $S_1$ or $\bar{S}_1$ and divides the frequency of this signal $S_1$ or $\bar{S}_1$ by two for producing an output square wave signal $S_2$ or $\bar{S}_2$ having a frequency (38 KHz) which is the same as that of the switching signal and a duty cycle of 50 percent. Actually both of the signals $S_2$ and $\bar{S}_2$ are usually produced as balanced outputs. One of these signals $S_2$ and $\bar{S}_2$ or both of these signals $S_2$ and $\bar{S}_2$ is/are applied via the third input terminal to the stereo demodulator SD.

In the stereo demodulator SD, the asymmetrical square wave signal $S_1$ applied via the second input terminal 26 and the square wave signal $S_2$ or $\bar{S}_2$ applied via the third input terminal 27 are used to produce a symmetrical square wave signal $S_3$ (see FIG. 15) and the composite stereo signal applied via the first input terminal 23 is multiplied by the signal $S_3$ to produce first and second output signals respectively indicative of the sub difference signal (L − R) and its inverted signal (R − L). These signals (L − R) and (R − L) are fed via the output terminals 28 and 29 of the stereo demodulator SD to the input terminals of the matrix MX. The matrix MX is also responsive to the main signal, i.e. the sum signal (L + R), included in the composite stereo signal so that the signals (L − R), (R − L) and (L + R) are matrixed to produce the left and right channel signals (L) and (R) and these left and right channel signals (L) and (R) will be obtained at the output terminals 24 and 25 of the stereo demodulator portion 22.

As in the above, to multiply the composite stereo signal by the asymmetrical square wave signal $S_1$, and subsequently by the symmetrical square wave signal $S_3$, which is obtained from the asymmetrical square wave signal $S_1$ and a square wave signal $S_2$ or $\bar{S}_2$, is equivalent to the multiplication of the composite signal by a multilevel product signal $S_4$ of the asymmetrical square wave signal $S_1$ and the symmetrical square wave signal $S_3$. Furthermore, to multiply the composite stereo signal by the asymmetrical square wave signal $S_1$, and subsequently by the symmetrical square wave signal $\bar{S}_3$ is equivalent to the multiplication of the composite stereo signal by a product signal $\bar{S}_4$ of the asymmetrical square wave signal $S_1$ and the symmetrical square wave signal $\bar{S}_3$. Consequently, the signal $S_4$ or signal $\bar{S}_4$ is the stereo multiplex decoding signal by which the composite stereo signal should be multiplied.

The above mentioned signals $S_4$ and $\bar{S}_4$ are of opposite phase with each other, and the fundamental frequency of these signals $S_4$ and $\bar{S}_4$ equals the frequency (38 KHz) of the suppressed carrier wave of the sub signal, while these signals $S_4$ and $\bar{S}_4$ are symmetrical square wave signals having three different levels.

Figure 16:
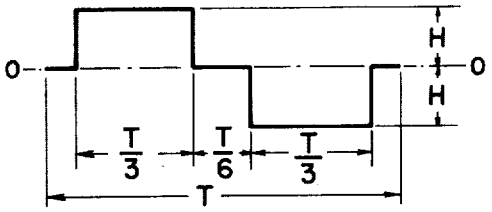
FIG. 16 is an enlarged view of the waveform of a signal $S_4$ shown in FIG. 15.

The detailed waveform of the signals $S_4$ and $\bar{S}_4$ which are used as stereo decoding signals, is shown in FIG. 16. The signal $S_4$ or $\bar{S}_4$ having the waveform of FIG. 16 may be mathematically expressed as follows:

$$\frac{2\sqrt{3H}}{\pi}\left(\sin\omega_{38}t - \frac{1}{5}\sin 5\omega_{38}t - \frac{1}{7}\sin 7\omega_{38}t + \frac{1}{11}\sin 11\omega_{38}t + \frac{1}{13}\sin 13\omega_{38}t - \frac{1}{17}\sin 17\omega_{38}t - \frac{1}{19}\sin 19\omega_{38}t + \ldots\right) \quad (4)$$

wherein

H is the amplitude level (peak to peak amplitude equals 2H);

T is the period; and $\omega_{38}$ is the fundamental angular frequency;

In the above formula (4), terms representative of the phase are omitted. As will be apparent from the above formula (4) the signals $S_4$ and $\bar{S}_4$ having the waveform of FIG. 16 (the waveforms of the signals $S_4$ and $\bar{S}_4$ are also shown in FIG. 15), which signals will be used as stereo multiplex decoding signals, do not have even harmonic components, a third harmonic component and the multiples of the third harmonic component. Therefore, even if unwanted frequency component in the vicinity of the third harmonic (114 KHz) of the stereo multiplex decoding signal is included in the composite stereo signal, this unwanted frequency component does not cause the stereo multiplex demodulating system to produce spurious signals.

The multiplex decoder of FIG. 14 will be further described in detail hereinbelow. The controllable oscillator VCO is so controlled that the signals $S_4$ and $\bar{S}_4$, which will be used as the decoding or switching signals, have a frequency equal to that of the suppressed carrier wave of the sub signal, and a predetermined phase relationship. The oscillation frequency of the oscillator VCO has to be determined in view of the construction of the following signal generator SG.

Namely, when a divided-by-3 frequency divider is used as the signal generator SG, the oscillation frequency of the oscillator VCO is six times the fundamental frequency of the stereo decoding signal, i.e. the oscillation frequency of the oscillator VCO is 228 KHz, so that the asymmetrical square wave signal $S_1$ or $\bar{S}_1$ shown in FIG. 15 is obtained by the signal generator SG, where the frequency of the signal $S_1$ or $\bar{S}_1$ is twice the fundamental frequency of the stereo decoding signal, and the duty cycle thereof is two third or one third.

Furthermore, when a monostable multivibrator is used as the signal generator SG which follows the oscillator VCO, the oscillation frequency of the oscillator VCO is made equal to twice the fundamental frequency of the stereo decoding signal so that the monostable multivibrator used as the signal generator SG is triggered by the oscillation wave of the oscillator VCO to produce the asymmetrical square wave signal $S_1$ or $\bar{S}_1$.

The signal generator SG is not limited to the above mentioned monostable multivibrator, and thus a switching circuit which performs ON/OFF operation with respect to a predetermined threshold value, may be used. In this case, the oscillator VCO is arranged to produce a saw tooth wave signal having a frequency equal to twice the fundamental frequency of the stereo decoding signal so that the switching circuit is responsive to the saw tooth wave signal to produce asymmetrical square wave signal $S_1$ or $\bar{S}_1$.

As the first and second frequency dividers Div-1 and Div-2, customary flip-flops may be used. The first frequency divider Div-1 divides the frequency of the input signal $S_1$ or $\bar{S}_1$ by two to produce the signal $S_2$ or $\bar{S}_2$ or both of the signals $S_2$ and $\bar{S}_2$, as a balanced output.

The first frequency divider Div-1 may be responsive to either the leading edge or the trailing edge of its input signal which is applied from the signal generator SG, if there is no delay during the frequency dividing operation.

The stereo demodulator SD multiplies the composite stereo signal applied via the first input terminal 23 by the symmetrical square wave signal $S_4$ or $\bar{S}_4$ which is obtained from the asymmetrical square wave signal $S_1$ from the signal generator SG and the square wave signal $S_2$ or $\bar{S}_2$ from the first frequency divider Div-1. Therefore there are various possibilities for the the arrangement of the stereo demodulator SD in accordance with the order of multiplications of these signals, and the polarity of these signals.

Figure 17:
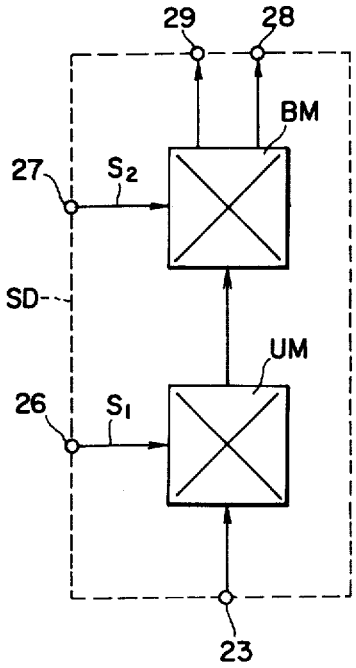
FIG. 17 is a block diagram of an embodiment of the stereo demodulator shown in FIG. 14.

Reference is now made to FIG. 17 which is a block diagram of an embodiment of the stereo demodulator SD shown in FIG. 14. The stereo demodulator SD of FIG. 17 comprises an unbalanced multiplier UM having input terminals respectively connected to the first and second input terminals 23 and 26, and a balanced multiplier BM having an input terminal connected to the third input terminal 27. The unbalanced multiplier UM has an output terminal connected to a second input terminal of the balanced multiplier BM which has two output terminals connected respectively to the output terminals 28 and 29. The composite stereo signal applied through the first terminal 23 to the unbalanced multiplier UM is multiplied by the asymmetrical square wave signal $S_1$ from the signal generator SG by a switching technique to produce a product output signal which will be fed to the balanced multiplier BM. The product signal from the unbalanced multiplier UM is multiplied by the symmetrical square wave signal $S_3$ or $\bar{S}_3$ the waveform of which is represented by the signal $S_2$ or $\bar{S}_2$ applied from the first frequency divider Div-1 to the third input terminal 27. As the result of the multiplication by the balanced multiplier BM, a first output signal indicative of the sub difference signal (L−R) and a second output signal indicative of the inverted difference (R−L) will be respectively obtained at the output terminals 28 and 29. In the above, although one of the signals $S_2$ or $\bar{S}_2$ is applied to the balanced multiplier BM from the first frequency divider Div-1, both of the signals $S_2$ and $\bar{S}_2$ may be applied to the balanced multiplier BM. Namely, the stereo demodulator SD of FIG. 17 substantially corresponds to the multiplier circuitry of FIG. 4. However, the construction of the stereo demodulator SD is not limited to such an arrangement, and therefore, any one of the multiplier arrangements already discussed in conjunction with FIG. 6 to FIG. 9 may be used as the stereo demodulator SD. It will be readily understood that the first and second input terminals 23 and 26 of FIG. 17 respectively correspond to the first and second input terminals 5 and 7 of FIGS. 4 and 9; the third input terminal 27 of FIG. 17 correspond to the third input terminal 8 or the third and fourth input terminals 8 and 9; and the output terminals 28 and 29 of FIG. 17 correspond to the output terminals 6 and 6*a*.

As described hereinbefore in connection with the phase splitter PS of FIG. 11, the phase splitter PS operates not only as a regular phase splitter but also as a matrix-adder, and this phase splitter PS of FIG. 11 may be used for the arrangements of FIG. 8 and FIG. 9. Namely, when the multiplier circuitry of FIG. 8 or FIG. 9 is used as the stereo demodulator SD of FIG. 14, the matrix MX shown in FIG. 14 is not needed any more because the phase splitter PS of FIG. 11 has the function of a matrix-adder.

Since the stereo decoding signal $S_4$ or $\bar{S}_4$ used for demodulating the composite stereo signal in the stereo demodulator SD does not have even harmonics, a third harmonic and the multiplies of the third harmonic at all, as being apparent from the waveform shown in FIG. 15, spurious signals will not be produced during demodulation even if unwanted frequency components in the vicinity of 114 KHz is included in the composite stereo signal applied from the FM detector.

Hereunder it will be described how the disadvantages and drawbacks inherent to conventional stereo decoding or switching signal generator, such as the PLL of FIG. 12, have been resolved by the present invention. As described hereinabove, the elements included in the switching signal generator SSG of FIG. 14 functions as a PLL to produce two output signals $S_1$ or $\bar{S}_1$ and $S_2$ or $\bar{S}_2$. In the conventional apparatus, the signal applied to the phase comparator PC of FIG. 12 to be compared with the pilot signal $S_p$ from the input terminal 21 is expressed by the formula (3) and its waveform is shown by the signal "g" in FIG. 13. This signal applied to the phase comparator PC as a comparison signal has a fifth harmonic component (95 KHz) and a seventh harmonic component (133 KHz) both having a relatively great amplitude so that spurious signal components are produced by the phase comparator PC in response to a signal component in the vicinity of 100 KHz from the FM detector.

According to the present invention, a specific signal is applied to the phase comparator PC as a comparison signal so that such undesirable result will not occur as will be described hereinbelow. The gate circuit GC of FIG. 14 is responsive to the signal $S_1$ or $\bar{S}_1$ from the signal generator SG and to the signal $S_2$ or $\bar{S}_2$ from the first frequency divider Div-1 to produce an output asymmetrical square wave signal $S_5$ or $\bar{S}_5$ the waveform of which is shown in FIG. 15. Meanwhile, the second frequency divider Div-2 produces an output square wave signal $S_6$ and/or $\bar{S}_6$ the waveform of which is also shown in FIG. 15. The phase comparator PC is responsive to these two signals, i.e. $S_5$ or $\bar{S}_5$ and $S_6$ or $\bar{S}_6$ to produce a comparison signal the waveform of which is shown by the symmetrical signal $S_8$ in FIG. 15. Namely, the asymmetrical square wave signal $S_5$ is multiplied by a symmetrical square wave signal $S_7$, which is obtained from one or both of the square wave signals $S_6$ and $\bar{S}_6$, to produce the symmetrical signal $S_8$ having three different levels. The gate circuit GC is so arranged that its output signal $S_5$ or $\bar{S}_5$ has a frequency equal to the fundamental frequency of the signal $S_4$, i.e. the stereo decoding signal, and a duty cycle of five sixth or one sixth, while the phase relationship between the signal $S_4$ and the signal $S_5$ or $\bar{S}_5$ is predetermined. This gate circuit GC may be constructed of a suitable logic gate, and the type of the logic gate will be determined in view of the polarity of the input signals thereof and the construction of the phase comparator PC to which the output signal $S_5$ or $\bar{S}_5$ of the gate circuit GC is applied. For instance, if it is intended to produce the signal $S_5$ as the output signal of the gate circuit GC, an OR gate may be used and signals $S_1$ and $\bar{S}_2$ may be respectively applied thereto, or an NAND gate may be used and signals $\bar{S}_1$ and $S_2$ may be respectively applied thereto. On the other hand, if it is intended to produce the signal $\bar{S}_5$ as the output signal of the gate circuit GC, or NOR gate may be used and signals $S_1$ and $\bar{S}_2$ may be applied thereto, or an AND gate may be used and signals $S_1$ and $S_2$ may be applied thereto.

If a flip-flop is used as the second frequency divider Div-2 which divides the frequency of the square wave signal $S_2$ or $\bar{S}_2$ from the first divider Div-1 by two to produce the square wave signal $S_6$ or $\bar{S}_6$ having a duty cycle of 50 percent, a pair of balanced outputs, i.e. the signal $S_6$ and its inverted signal $\bar{S}_6$ may be obtained at its outut terminals.

The phase comparator PC of FIG. 14 operates as follows: The composite stereo signal, which includes at least the pilot signal $S_p$, applied via the input terminal 21 of the switching signal generator SSG is multiplied by the symmetrical square wave signal $S_5$ from the gate circuit GC, and subsequently by the symmetrical square wave signal $S_7$ which is obtained from the output signal $S_6$ or $\bar{S}_6$ (or both of these signals $S_6$ and $\bar{S}_6$) from the second frequency divider Div-2. The order of the above mentioned two multiplications may be reversed and various types of multipliers may be used as the phase comparator PC.

Figure 18:
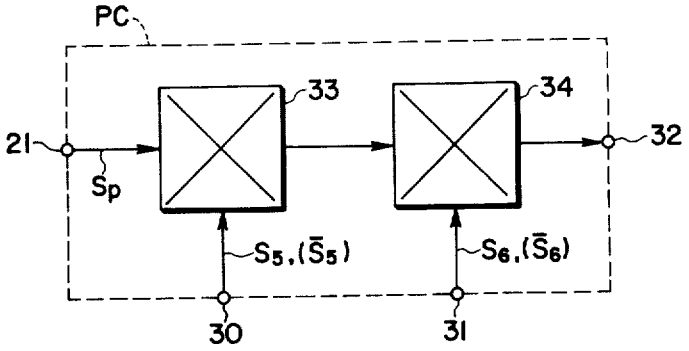
FIG. 18 is a block diagram of an embodiment of the phase comparator shown in FIG. 14.

FIG. 18 is a block diagram of an embodiment of the phase comparator PC of FIG. 14. The phase comparator PC comprises first and second multipliers 33 and 34 connected in series. The first multiplier 33 has first and second input terminals respectively connected to the terminals 21 and 30 so that the first multiplier 33 multiplies the composite stereo signal which includes at least the pilot signal $S_p$ by the signal $S_5$ from the gate circuit GC to produce a product outut signal. This product signal is applied to an input terminal of the second multiplier 34 (balanced multiplier) which has an input terminal connected to the terminal 31, and thus the product signal from the first multiplier 33 is multiplied by the symmetrical square wave $S_7$ which is obtained from the signal $\bar{S}_6$ or $S_6$ from the second frequency divider Div-2. With this operation an output signal indicative of the product of the composite stereo signal and the symmetrical three-level signal $S_8$ is obtained at the output terminal 32 of the phase comparator PC. Usually a pair of balanced outputs is obtained at the output terminals of the balanced multiplier 34.

Figure 19:
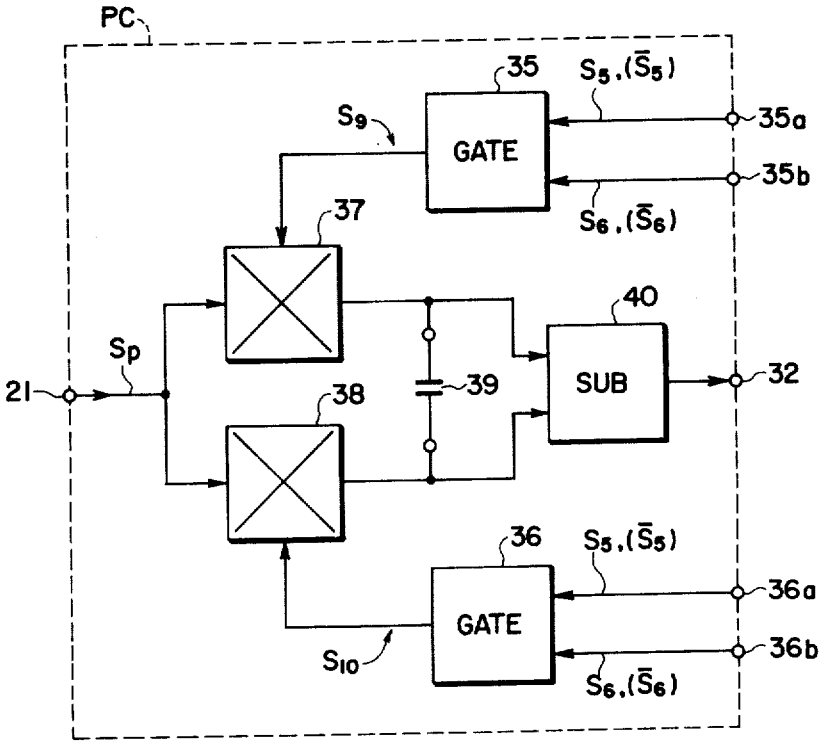
FIG. 19 is a block diagram of another embodiment of the phase comparator shown in FIG. 14.

FIG. 19 is a block diagram of another embodiment of the phase comparator PC of FIG. 14. The circuitry of FIG. 19 comprises first and second multipliers 37 and 38, first and second gate circuits 35 and 36, a subtracter 40 and a capacitor 39. The first gate circuit 35 has first and second input terminals 35*a* and 35*b* respectively responsive to the output signals $S_5$ or $\bar{S}_5$ and $S_6$ or $\bar{S}_6$ of the gate circuit GC and the second frequency divider Div-2. The second gate circuit 36 also has first and second input terminals 36*a* and 36*b* respectively responsive to the outut signals $S_5$ or $\bar{S}_5$ and $\bar{S}_6$ or $S_6$ of the gate circuit GC and the second frequency divider Div-2. The first gate circuit 35 has an output terminal connected to an input terminal of the first multiplier 37, while the second gate circuit 36 has an output terminal connected to an input terminal of the second multiplier 38. Each of the first and second multipliers 37 and 38 has another input terminal connected to the input terminal 21 of the switching signal generator SSG. An output terminal of the first multiplier 37 is connected to a first input terminal of the subtracter 40, while an output terminal of the second multiplier 38 is connected to a second input terminal of the subtracter 40. The capacitor 39 is connected between the output terminals of the first and second multipliers 37 and 38. An output terminal of the subtractor 40 is connected to the output terminal 32 of the phase comparator PS.

The first gate circuit 35 may be an AND gate when the input signals thereof are $S_5$ and $S_6$, and may be a NOR gate when the input signals are $\bar{S}_5$ and $\bar{S}_6$. The second gate circuit 36 may be an AND gate when the input signals thereof are $S_5$ and $\bar{S}_6$, and may be a NOR gate when the input signals thereof are $\bar{S}_5$ and $S_6$. Therefore, the first gate circuit 35 produces an output signal $S_9$ the waveform of which is shown in FIG. 15, while the second gate circuit 36 produces an output signal $S_{10}$ the waveform of which is also shown in FIG. 15. The output signal $S_9$ of the first gate circuit 35 has a frequency equal to the output signal $S_6$ or $\bar{S}_6$ of the second frequency divider Div-2, and a duty cycle of five twelfth. This signal $S_9$ may be produced in the form of its inverted signal. The output signal $S_{10}$ of the second gate circuit 36 has the same frequency and duty cycle as the signal $S_9$, but the phase of the signal $S_{10}$ is different from that of the signal $S_9$ by 180 degrees. The signals $S_{10}$ may be produced in the form of its inverted signal. These signals $S_9$ and $S_{10}$ are respectively fed to the first and second multipliers 37 and 38 which are also responsive to the composite stereo signal having the pilot signal $S_p$ therein, so that the composite stereo signal is multiplied by the signal $S_9$, and the signal $S_{10}$ respectively. As the result of these multiplications, first and second product signals are obtained and these product signals are fed to the subtracter 40. The subtracter 40 produces an output signal indicative of the difference between these two product signals.

From the above it will be understood that although the composite stereo signal is multiplied by the signals $S_9$ and $S_{10}$ respectively, and the difference between the two products is detected, this operation is substantially the same as the multiplication of the composite stereo signal by the symmetrical three-level signal $S_8$ shown in FIG. 15. Namely, in the phase comparator PS of FIG. 19, the signal $S_8$ is obtained by multiplying the signal $S_5$ by the signal $S_7$, and then the composite stereo signal is multiplied by this signal $S_8$. However, the signal $S_8$ is not directly obtained in the above first multiplication. In place of the multiplication of the signal $S_5$ by the signal $S_7$, the signal $S_5$ is multiplied by signals $S_6$ and $S_6$ respectively and the difference between the two products is detected. It will be noticed that the signal $S_6$ minus the signal $\bar{S}_6$ equals the signal $S_7$ and because of the provision of the subtractor 40 which follows the first and second multipliers 37 and 38 the combination of the signals $S_6$ and $\bar{S}_6$ can be considered as it has the waveform of the signal $S_7$.

As described in the above, the product signal of the composite stereo signal and the symmetrical wave signal $S_8$ is readily obtained by multiplying the composite stereo signal by asymmetrical signals respectively and combining the results of the multiplications by subtracting one product signal from the other.

The capacitor 39 functions as a low pass filter since the capacitor 39 constitutes a filter together with the output resistive and capacitive impedances, and the low pass filter gives the balanced outputs of the phase comparator PC a predetermined low-pass characteristic. This low pass filter corresponds to the aforementioned low pass filter LPF shown in FIG. 14, and therefore, the low pass filter LPF of FIG. 14 can be substituted by the capacitor 39. A filter of lag-lead type, which comprises a parallel circuit of a capacitor and series circuit of a capacitor and a resistor, may be used in place of the capacitor 39 to function as a low pass filter.

Although the subtractor 40 is shown in FIG. 19 to be included in or part of the phase comparator PC, if the direct current amplifier DA of FIG. 14 has an input stage of balanced differential type, the d.c. amplifier may serve as a subtracter so that the subtracter 40 of FIG. 19 may be omitted.

In case that the phase comparator PC is constructed as illustrated in FIG. 18, the second multiplier 34 may be readily constructed of a balanced output type multiplier, and when such a balanced output type multiplier is used as the second multiplier 34, a subtracter which will be required to detect the difference between the two outputs may be incorporated in the d.c. amplifier having a differential input stage, which follows the balanced output type multiplier.

Furthermore, in case that the arrangement of FIG. 19 is used as the phase comparator PC, the gate circuit GC shown in FIG. 14 may be omitted if each of the gate circuits 35 and 36 has three input terminals respectively responsive to the output signal $S_1$ or $\bar{S}_2$, of the first frequency divider Div-1, and to the output signal $S_6$ or $\bar{S}_6$ of the second frequency divider Div-2, while the inner construction of each gate circuit 35 and 36 is suitably arranged.

Of course the construction of the phase comparator PC is not limited to the above described examples, and also various modifications may be made for those examples.

As is well known, the low pass filter LPF gives an important characteristic which influences the response characteristic of the loop of the PLL of the switching signal generator SSG, especially the capture range characteristic and the spurious signal blocking characteristic are influenced by the low pass filter LPF. The d.c. amplifier DA has to be of the type of balanced differential inputs if the phase comparator PC is of the type of balanced outputs or the type which requires subtraction between the outputs thereof. The error or difference represented by the output signal of the phase comparator PC is applied to the low pass filter LPF in which the high frequency components are eliminated therefrom. The error signal from which the high frequency components are eliminated is amplified by the d.c. amplifier and is applied to the control input terminal of the oscillator VCO as a control voltage or current.

The free running frequency of the oscillator VCO is so adjusted that the frequency of the output signal of the second frequency divider Div-2 approximately equals 19 KHz. The transmission characteristic of the low pass filter LPF is suitably determined so that the combination of the phase comparator PC, low pass filter LPF, d.c. amplifier DA, oscillator VCO, signal generator SG, first and second frequency dividers Div-1 and Div-2, and the gate circuit GC functions as a PLL.

The phase comparator PC produces the error signal in the following manner. The pilot signal $S_p$ included in the composite stereo signal is multiplied by the signal $S_5$ or $\bar{S}_5$ from the gate circuit GC and subsequently by the symmetrical square wave signal $S_7$ which is obtained from the signal $S_6$ or $\bar{S}_6$, namely, the pilot signal having a frequency of 19 KHz is substantially multiplied by the symmetrical wave signal $S_8$, whose frequency is 19 KHz, to produce the error signal, and this error signal is fed to the low pass filter LPF. The above mentioned loop functions as a well known PLL in which the symmetrical wave signal $S_8$ is under the locked condition with respect to the pilot signal $S_p$ so that these two signals $S_8$ and $S_p$ have the same frequency, while the phase difference therebetween is 90 degrees. Under the condition that the PLL is locked the phase relationship between the signal $S_4$ or $\bar{S}_4$ and the symmetrical signal $S_8$ is such that shown in FIG. 15 and therefore, the signal $S_4$ or $\bar{S}_4$ has a frequency equal to that of the suppressed carrier of the sub signal, while these two signals $S_4$ or $\bar{S}_4$ and $S_8$ are in-phase or opposite-phase. Accordingly, the signal $S_4$ or $\bar{S}_4$ can be used as a stereo decoding signal.

The comparison signal which is multiplied by the pilot signal $S_p$ supplied to the phase comparator PC of the switching signal generator of FIG. 14 as a reference signal is the abovementioned symmetrical wave signal $S_8$, and this symmetrical wave signal $S_8$ may be mathematically expressed as follows:

$$\frac{4C}{\pi}\sum_{n=1}^{\infty}\left\{\frac{1}{2n-1}\cos\frac{2n-1}{12}\pi\cdot\sin(2n-1)\omega_{19}t\right\} \approx \frac{3.864\,C}{\pi}\{\sin\omega_{19}t + 0.244\sin3\omega_{19}t + 0.054\sin5\omega_{19}t - 0.038\sin7\omega_{19}t - 0.081\sin9\omega_{19}t - \ldots\} \quad (5)$$

wherein

C is the amplitude level of the signal $S_8$ (peak to peak amplitude equals 2 C); and $\omega_{19}$ is angular frequency of the signal $S_8$, and this angular frequency becomes equal to that of the pilot signal $S_p$ under the locked condition of the PLL:

In the above formula (5), terms indicative of the phase are omitted.

By comparing the above formula (5) and the formula (3) which is indicative of the comparison signal applied to the phase comparator PC of FIG. 12, namely the comparison signal used in the conventional switching signal generator, it will be recognized that the amplitudes of the fifth and seventh harmonics of the signal $S_8$ are remarkably smaller than those of the comparison signal used in the conventional apparatus as follows:

(1) The amplitude of the fifth harmonic (95 KHz) of the fundamental frequency (19 KHz) in the formula (3) is 0.2 times the amplitude of the fundamental frequency (19 KHz), while the amplitude of the fifth harmonic (95 KHz) of the fundamental frequency (19 KHz) in the formuls (5) is 0.054 times the amplitude of the fundamental frequency (19 KHz).

(2) The amplitude of the seventh harmonic (133 KHz) of the fundamental frequency (19 KHz) in the formula (3) is 0.143 times the amplitude of the fundamental frequency (19 KHz), while the amplitude of the seventh harmonic (133 KHz) of the fundamental frequency (19 KHz) in the formula (5) is 0.038 times the amplitude of the fundamental frequency (19 KHz).

From the above comparison, it will be understood that the amplitudes of the fifth and seventh harmonics of the symmetrical wave signal expressed by the formula (5) are respectively reduced as much as 11 dB from the amplitudes of the fifth and seventh harmonics of the symmetrical wave signal expressed by the formula (3).

Consequently, in the switching signal generator SSG of FIG. 14, the degree of the generation of spurious signals is very low compared to the conventional apparatus even if unwanted signal components having a frequency in the vicinity of 95 KHz or 133 KHz is included in the input composite stereo signal applied to the input terminal 21 of the switching signal generator SSG. As the result, the spurious-signal-rejection characteristic is improved as much as this degree compared to the conventional apparatus of FIG. 12.

The stereo multiplex decoder to which the method and apparatus for multiplying an electrical signal according to the present invention is adapted, may be constructed of an integrated circuit so that a stable stereo multiplex decorder of low cost may be readily provided.

What is claimed is:

1. A method of multiplying an input electrical signal by a multiplier electrical signal, comprising the steps of:

(a) producing an asymmetrical square wave signal having a frequency which equals twice the frequency of said multiplier signal, a first predetermined phase and a duty cycle of two thirds;

(b) producing a symmetrical square wave signal having the same frequency as that of said multiplier signal and a second predetermined phase; and (c) multiplying said input electrical signal by said asymmetrical square wave signal and subsequently by said symmetrical square wave signal or vice versa to obtain a product of said multiplications.

2. A method of multiplying an input electrical signal by a multi-level multiplier, comprising the steps of:

(a) producing a first asymmetrical square wave signal having a frequency which equals twice the fundamental frequency of said multiplier, a first predetermined phase and a duty cycle of two third;

(b) producing at least one or both of second and third asymmetrical square wave signals having the same frequency as said fundamental frequency of said multiplier, said second and third asymmetrical square wave signals respectively having second and third phases, and said third asymmetrical square wave signal being an inverted signal of said second asymmetrical square wave signal;

(c) switching said input electrical signal in accordance with said first asymmetrical square wave signal to obtain a primary product signal; and (d) switching said primary product signal in accordance with at least one of said second and third asymmetrical square wave signals to obtain a product of said input electrical signal and said multiplier which corresponds with the product of said first asymmetrical square wave signal and a symmetrical square wave signal having the same frequency as said fundamental frequency of said multiplier and a phase equal to said second predetermined phase.

3. A method of multiplying an input electrical signal by a multi-level multiplier, comprising the steps of:

(a) producing a first asymmetrical square wave signal having a frequency which equals twice the fundamental frequency of said multiplier, a first predetermined phase and a duty cycle of two third;

(b) producing at least one or both of second and third asymmetrical square wave signals having the same frequency as said fundamental frequency of said multiplier, said second and third asymmetrical square wave signals respectively having second and third phases, and said third asymmetrical square wave signal being an inverted signal of said second asymmetrical square wave signal;

(c) switching said input electrical signal in accordance with at least one of said second and third asymmetrical square wave signals to obtain a product signal of said input electrical signal and one of said second and third asymmetrical square wave signals and an inverted signal of said product signal;

(d) switching respectively said product signal and said inverted product signal in accordance with said first asymmetrical square wave signal to obtain first and second product signals; and (e) subtracting said second product signal from said first product signal to produce an output product signal indicative of the product of said input electrical signal and said multiplier which corresponds with the product of said first asymmetrical square wave signal and a symmetrical square wave signal having the same frequency as said fundamental frequency of said multiplier and a phase equal to said second predetermined phase.

4. A multiplier circuitry for multiplying an input electrical signal by a multi-level multiplier, comprising:

(a) an oscillator for producing an oscillation signal the frequency of which is a multiple of the fundamental frequency of said multi-level multiplier, said oscillation frequency having a predetermined phase;

(b) a first signal generator responsive to said oscillation signal for producing an asymmetrical square wave signal having a frequency which equals twice the fundamental frequency of said multi-level multiplier, a predetermined duty cycle and a predetermined phase;

(c) a frequency divider responsive to said asymmetrical square wave signal from said first signal generator for dividing the frequency of said asymmetrical square wave signal by two, said frequency divider producing at least one output signal;

(d) a second signal generator responsive to said input electrical signal, to said asymmetrical square wave signal from said first signal generator and to said output signal of said frequency divider, for multiplying said input electrical signal by said asymmetrical square wave signal and subsequently by a symmetrical square wave signal, which is obtained from said output signal of said frequency divider, or vice versa to produce an output product signal.

5. A multiplier circuitry as claimed in claim 4, wherein said oscillator comprises a voltage-controlled oscillator responsive to the voltage of said input electrical signal.

6. A multiplier circuitry as claimed in claim 4, wherein said oscillator comprises a current-controlled oscillator responsive to the current of said input electrical signal.

7. A multiplier circuitry as claimed in claim 4, wherein said oscillator comprises a saw tooth wave signal generator responsive to said input electrical signal.

8. A multiplier circuitry as claimed in claim 4, wherein said first signal generator comprises a divide-by-three frequency divider.

9. A multiplier circuitry as claimed in claim 4, wherein said first signal generator comprises a monostable multivibrator.

10. A multiplier circuitry as claimed in claim 4, wherein said first signal generator comprises a threshold circuit responsive to the output signal of said oscillator and to a reference signal.

11. A multiplier circuitry as claimed in claim 4, wherein said frequency divider comprises a flip-flop.

12. A multiplier circuitry as claimed in claim 4, wherein said second signal generator comprises:

(a) an unbalanced multiplier for multiplying said input electrical signal by said asymmetrical square wave signal from said first signal generator to produce a primary product signal; and (b) a balanced multiplier for multiplying said primary product signal by said symmetrical square wave signal.

13. A multiplier circuitry as claimed in claim 12, wherein said unbalanced multiplier comprises a switching circuit controlled by said asymmetrical square wave signal.

14. A multiplier circuitry as claimed in claim 12, wherein said balanced multiplier comprises a phase splitter responsive to said primary product signal for producing two output signals having opposite phase with each other, and a gang switching circuit of double-pole double-throw type for switching over said two output signals in accordance with said output signal of said frequency divider, or its inverted signal.

15. A multiplier circuitry as claimed in claim 12, wherein said balanced multiplier comprises a phase splitter responsive to said primary product signal for producing two output signals having opposite phase with each other, and a pair of switching circuits for respectively switching over said two output signals in accordance with said output signal of said frequency divider and its inverted signal.

16. A multiplier circuitry as claimed in claim 4, wherein said second signal generator comprises:

(a) a first unbalanced multiplier for multiplying said input electrical signal by said asymmetrical square wave signal from said first signal generator to produce a primary product signal;

(b) a second unbalanced multiplier for multiplying said primary product signal by said output signal of said frequency divider to produce an output signal;

(c) a third unbalanced multiplier for multiplying said primary product signal by an inverted signal of said output signal of said frequency divider to produce an output signal; and (d) a subtracter responsive to the output signals of said second and third unbalanced multipliers for producing at least one output signal indicative of the difference between the output signals of said second and third unbalanced multipliers.

17. A multiplier circuitry as claimed in claim 4, wherein said second signal generator comprises:

(a) a first unbalanced multiplier for multiplying said input electrical signal by said output signal of said frequency divider to produce an output signal;

(b) a second unbalanced multiplier for multiplying input electrical signal by an inverted signal of said output signal of said frequency divider to produce an output signal;

(c) a third unbalanced multiplier for multiplying said output signal of said first unbalanced multiplier by said asymmetrical square wave signal from said first signal generator to produce an output signal;

(d) a fourth unbalanced multiplier for multiplying said output signal of said second unbalanced multiplier by said asymmetrical square wave signal from said first signal generator to produce an output signal; and (e) a subtracter responsive to the output signals of said third and fourth unbalanced multipliers for producing at least one output signal indicative of the difference between the output signals of said third and fourth unbalanced multipliers.

18. A multiplier circuitry as claimed in claim 4, wherein said second signal generator comprises:

(a) a balanced multiplier for multiplying said input electrical signal by said symmetrical square wave signal obtained from said output signal of said frequency divider and/or its inverted signal, said balanced multiplier producing first and second balanced output signals at its two output terminals; and (b) a switching circuit interposed between said two output terminals of said balanced multiplier for making a short circuit in accordance with said asymmetrical square wave signal from said first signal generator.

19. A multiplier circuitry as claimed in claim 18, wherein said balanced multiplier comprises a phase splitter responsive to said input electrical signal for producing two output signals having opposite phase with each other, and a gang switching circuit of double-pole double-throw type for switching over said two output signals in accordance with said output signal of said frequency divider or its inverted signal.

20. A multiplier circuitry as claimed in claim 18, wherein said balanced multiplier comprises a phase splitter responsive to said input electrical signal for producing two output signals having opposite phase with each other, and a pair of switching circuits for respectively switching over said two output signals in accordance with said output signal of said frequency divider and its inverted signal.

21. A multiplier circuitry as claimed in claim 4, wherein said second signal generator comprises:

(a) a phase splitter responsive to said input electrical signal for producing first and second output signals having opposite phase with each other;

(b) a gang switching circuit of triple-pole double-throw type for switching over said first and second output signals from said first signal generator, said output signal of said frequency divider and the inverted signal of said output signal of said frequency divider being fed to said gang switching circuit as switching control signals, these three switching control signals respectively assuming high and low levels, the high level voltage of said asymmetrical square wave signal from said first signal generator being higher than the high level voltage of the remaining switching control signals; and (c) an adder-distributor having first and second input terminals and first and second output terminals, said first and second output terminals being respectively connected to first and second output terminals of said second signal generator, said first and second output signals of said phase splitter being respectively fed to said first and second output terminals of said second signal generator when the voltage of said output signal of said frequency divider is the highest among said three switching control signals, said first and second output signals of said phase splitter being respectively fed to said first and second input terminals of said adder-distributor when the voltage of said asymmetrical square wave signal is the highest among said three switching control signals, and said first and second output signals of said phase splitter being respectively fed to said second and first output terminals of said second signal generator when the voltage of said inverted signal is the highest among said three switching control signals.

22. A multiplier circuitry as claimed in claim 14, 15, 19, 20 or 21, wherein said phase splitter comprises:

(a) a first transistor having a base electrode for receiving an input signal;

(b) a second transistor having a base electrode connected via a bias source to ground;

(c) a series circuit of two resistors, said series circuit being interposed between the emitter electrodes of said first and second transistors; and (d) a constant-current source connected between a junction connecting said two resistors, and ground.

23. A multiplier circuitry as claimed in claim 19, 20 or 21 wherein said phase splitter comprises:

(a) a first transistor having a base electrode for receiving an input signal;

(b) a second transistor having a base electrode connected via a bias source to ground;

(c) a first resistor connected between the emitter electrodes of said first and second transistors; and (d) second and third resistors respectively interposed between the emitter electrodes of said first and second transistors, and ground.

24. A method of FM stereo multiplex decoding a composite stereo signal including at least a main signal indicative of the sum (L+R) of the left and right channel signals (L) and (R), a sub signal indicative of the difference (L−R) between the left and right channel signals (L) and (R), and a pilot signal of a predetermined frequency, comprising the steps of:

(a) producing an asymmetrical square wave signal having a frequency which equals four times the frequency of said pilot signal, a predetermined phase and a duty cycle of two third;

(b) producing a symmetrical square wave signal having a frequency which equals twice the frequency of said pilot signal, and a predetermined phase;

(c) multiplying said composite stereo signal by said asymmetrical square wave signal and by said symmetrical square wave signal to obtain the difference component (L−R) and its inverted component (R−L); and (d) matrixing said sum component (L+R), said difference component (L−R) and said inverted difference component (R−L) to demodulate said left and right channel signals (L) and (R) respectively.

25. An FM stereo multiplex decoding system for demodulating a composite stereo signal obtained by an FM detector, comprising:

(a) an oscillator for producing a signal having a frequency which is a multiple of a suppressed sub carrier wave of said composite stereo signal, and a predetermined phase;

(b) a signal generator responsive to the output signal of said oscillator for producing an asymmetrical square wave signal having a frequency which equals twice the frequency of said suppressed sub carrier wave, a predetermined duty cycle and a predetermined phase;

(c) a frequency divider for dividing the frequency of said asymmetrical square wave signal by two; and (d) a stereo demodulator for multiplying said composite stereo signal by said asymmetrical square wave signal, and subsequently by the output signal of said frequency divider of vice versa for obtaining a difference component (L−R) and an inverted difference component (R−L) of the left and right channel signals (L) and (R), said stereo demodulator having a matrix means for matrixing said composite stereo signal, said difference component (L−R) and said inverted difference component (R−L) to demodulate said left and right channel signals (L) and (R) respectively.

26. An FM stereo multiplex decoding system for demodulating a composite stereo signal obtained by an FM detector, comprising:

(a) an oscillator the oscillation frequency of which is controllable;

(b) a signal generator responsive to the output signal of said oscillator for producing an asymmetrical square wave signal having a predetermined duty cycle and a predetermined phase;

(c) a first frequency for dividing the frequency of said asymmetrical square wave signal by two;

(d) a second frequency divider for dividing the frequency of the output signal of said first frequency divider by two;

(e) a gate circuit responsive to said asymmetrical square wave signal and to said output signal of said first frequency divider for producing a square wave signal having the same frequency as said output signal of said first frequency divider and a predetermined duty cycle;

(f) a phase comparator responsive to said composite stereo signal having at least a pilot signal component, to the output signal of said second frequency divider and to the output signal of said gate circuit for multiplying said composite stereo signal by said output signal of said gate circuit and subsequently by said output signal of said second frequency divider or vice versa to produce a product signal;

(g) a low pass filter for passing a low frequency component of the output signal of said phase comparator;

(h) a d.c. amplifier responsive to the output signal of said low pass filter to produce an output signal which is fed to an input terminal of said oscillator to control the oscillation frequency thereof, said oscillator, signal generator, first and second frequency dividers, gate circuit, phase comparator, low pass filter and d.c. amplifier constituting a phase locked loop so that the frequency of said asymmetrical square wave signal produced by said signal generator equals twice the frequency of a suppressed sub carrier wave of said composite stereo signal, while the frequency of the output signal of said first frequency divider equals the frequency of said suppressed sub carrier signal;

(i) a stereo demodulator for multiplying said composite stereo signal by said asymmetrical square wave signal from said signal generator, and subsequently by the output signal of said first frequency divider or vice versa for obtaining a difference component (L−R) and an inverted difference component (R−L) of the left and right channel signals (L) and (R), said stereo demodulator having a matrix means for matrixing said composite stereo signal, said difference component (L−R) and said inverted difference component (R−L) to demodulate said left and right channel signals (L) and (R) respectively.

27. An FM stereo multiplex decoding system as claimed in claim 26, wherein said phase comparator comprises:

(a) a first multiplier for multiplying said pilot signal component by said output signal of said gate circuit to produce a product signal; and (b) a second multiplier for multiplying said product signal from said first multiplier by said output signal of said second frequency divider.

28. An FM stereo multiplex decoding system as claimed in claim 26, wherein said phase comparator comprises:

(a) first and second gate circuits respectively responsive to the output signal of said gate circuit and to the output signal of said second frequency divider for producing respective output signals;

(b) first and second multipliers for respectively multiplying said pilot signal component by said output signal of said first gate circuit and subsequently by said output signal of said second gate circuit or vice versa; and (c) a substracter responsive to the output signals of said first and second multipliers for producing an output signal indicative of the difference between the output signals of said first and second multipliers.

29. An FM stereo multiplex decoding system as claimed in claim 28, wherein said low pass filter comprises a capacitor connected between the output terminals of said first and second multipliers.

* * * * *